US006312881B1

(12) United States Patent
Gibson et al.

(10) Patent No.: US 6,312,881 B1
(45) Date of Patent: Nov. 6, 2001

(54) PHOTOGRAPHIC ELEMENT WITH YELLOW DYE-FORMING COUPLER AND STABILIZING COMPOUNDS

(75) Inventors: Danuta Gibson, Watford (GB); James S. Honan, Spencerport, NY (US); Llewellyn J. Leyshon, Watford (GB); Thomas A. Rosiek, Honeoye Falls; Brian Thomas, Pittsford, both of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/483,396

(22) Filed: Jan. 14, 2000

(51) Int. Cl.[7] ..... G03C 1/08; G03C 7/26; G03C 7/32

(52) U.S. Cl. ..... 430/551; 430/556; 430/557

(58) Field of Search ..... 430/543, 556, 430/557, 551

(56) References Cited

U.S. PATENT DOCUMENTS

| | | | | |
|---|---|---|---|---|
| 4,749,645 | * | 6/1988 | Goddard et al. . | |
| 4,782,011 | * | 11/1988 | Goddard et al. . | |
| 5,017,465 | * | 5/1991 | Nishijima . | |
| 5,082,766 | * | 1/1992 | Nishijima et al. . | |
| 5,091,294 | * | 2/1992 | Nishijima et al. . | |
| 5,236,819 | * | 8/1993 | Kadokura et al. . | |
| 5,284,742 | * | 2/1994 | Yamazaki et al. . | |
| 5,294,530 | * | 3/1994 | Seto et al. . | |
| 5,362,615 | * | 11/1994 | Hagemann et al. | 430/551 |
| 5,415,989 | * | 5/1995 | Wolff et al. . | |
| 5,426,021 | * | 6/1995 | Krishnamurthy et al. . | |
| 5,426,022 | * | 6/1995 | Hagemann | 430/551 |
| 5,441,855 | * | 8/1995 | Weber et al. . | |
| 5,441,861 | * | 8/1995 | Weber et al. . | |
| 5,466,569 | * | 11/1995 | Weber et al. . | |
| 5,484,696 | * | 1/1996 | Jain et al. . | |
| 5,491,054 | * | 2/1996 | Jain et al. . | |
| 5,523,199 | * | 6/1996 | Lau et al. . | |
| 5,561,037 | * | 10/1996 | Jain et al. . | |
| 5,565,312 | * | 10/1996 | Jain | 430/551 |
| 5,567,578 | * | 10/1996 | Makuta et al. . | |
| 5,891,613 | * | 4/1999 | Zengerle et al. . | |
| 5,925,503 | * | 7/1999 | Harder et al. | 430/551 |
| 5,935,773 | | 8/1999 | Hagemann et al. . | |
| 6,013,429 | * | 1/2000 | Franke et al. | 430/551 |
| 6,030,760 | * | 2/2000 | Shuttleworth et al. | 430/551 |
| 6,037,113 | * | 3/2000 | Shuttleworth et al. | 430/551 |
| 6,048,680 | * | 4/2000 | Saeva et al. | 430/551 |
| 6,071,686 | * | 6/2000 | Cowan et al. | 430/551 |
| 6,096,493 | * | 8/2000 | Shuttleworth et al. | 430/557 |
| 6,136,522 | * | 10/2000 | Lau et al. | 430/551 |
| 6,171,773 | * | 1/2001 | Bergthaller et al. | 430/551 |

FOREIGN PATENT DOCUMENTS

| | | | |
|---|---|---|---|
| 4320828 | * | 1/1995 | (DE) . |
| 310551 | * | 4/1989 | (EP) . |
| 310552 | * | 4/1989 | (EP) . |
| 508398 | * | 10/1992 | (EP) . |
| 538862 | * | 4/1993 | (EP) . |
| 1267287 | * | 3/1972 | (GB) . |
| 6-266075 | * | 9/1994 | (JP) . |
| 91/08515 | * | 6/1991 | (WO) . |

* cited by examiner

*Primary Examiner*—Geraldine Letscher
(74) *Attorney, Agent, or Firm*—Andrew J. Anderson

(57) ABSTRACT

In accordance with one embodiment of the invention, a photographic element is disclosed comprising a silver halide emulsion layer having associated therewith an acetanilide-based yellow dye forming coupler and a stabilizer compound of the formula S-I:

wherein $R^0$ represents an aryl or heterocyclic group; $R^a$ is H or a substituent group; L represents an alkylene linking group and p represents 0 or 1; and $R^b$ is a substituent group, provided that substituent groups represented by $R^a$ and $R^b$ may be joined to form a ring. The presence of substituted amine compounds of formula S-I improves the efficiency of dye formation reaction for acetanilide-based couplers. When used in combination with known bis-phenolic stabilizers, substantial improvements in the light stability of the image dyes can be also be obtained. Accordingly, photographic elements of the present invention upon exposure and photographic processing exhibit good activity and yield yellow dye images that have low fading when exposed to light.

23 Claims, No Drawings

PHOTOGRAPHIC ELEMENT WITH YELLOW DYE-FORMING COUPLER AND STABILIZING COMPOUNDS

FIELD OF THE INVENTION

This invention relates to silver halide color photographic materials. More particularly, it relates to color photographic materials which contain yellow dye-forming couplers in combination with certain non-imaging compounds which enhance the efficiency of generation of the image dye and also give rise to images which have unexpectedly high stability towards fading by light.

BACKGROUND OF THE INVENTION

In a silver halide photographic element, a color image is formed when the element is exposed to light and then subjected to color development with a primary aromatic amine developer. Color development results in imagewise reduction of silver halide and production of oxidized developer. Oxidized developer reacts with one or more incorporated dye-forming couplers to form an imagewise distribution of dye.

In any polychromatic chromogenic photographic material it is desirable that the dyes so formed should have certain properties. For instance the dyes should be bright in color with very little secondary absorption so that good color reproducibility is obtained. For yellow dyes in particular, color purity is enhanced by ensuring that the absorption maximum of the dye is well separated from that of the magenta dye, and hence yellow dyes that absorb at shorter wavelengths are advantageous. Acetanilide-based yellow dye-forming couplers have been found to provide desirable dye hues. The dyes that are formed by any color coupler during processing have a tendency to fade over time as a result of exposure to light, heat, humidity and oxygen. Since the three image dyes may not fade at the same rate, an apparent change in image color may result. It is thus paramount that the formed photographic dye images should be resistant towards fading by heat, humidity and light.

When the dye images are formed in silver halide photographic materials from the combination of oxidized developer and an incorporated coupler, certain restrictions are placed on the properties of the coupler. For instance, the coupler should produce a dye which has the aforementioned desirable properties and the efficiency of the dye-forming reaction must be high. Additionally, the coupler must be easily dispersible, must itself be resistant towards the deleterious effects of light, heat and humidity, and must have a low propensity to form fog.

Acetanilide-based yellow dye-forming couplers of the general structures described in this invention are well known in the art of photography. It is also well known in the art of coupler chemistry that the incorporation of specific functionalities into the molecule can enhance features such as coupling reactivity or high image dye light stability. Another well-proven route to improve image dye light stability is to incorporate certain stabilizing addenda into the coupler dispersion. Such stabilizing addenda can be used alone or in combination. Compounds which have been disclosed as stabilizers for yellow image dyes include substituted phenolic and blocked phenolic compounds, including heterocyclic phosphorous compounds (U.S. Pat. No. 4,749,645), phenolic thiane derivatives ((EP 0 310 551) and substituted bisphenols (UK 1,267,287), among which mono-blocked derivatives have been shown to be especially advantageous (U.S. Pat. No. 4,782,011). The use of substituted bisphenols and blocked bisphenols as light stabilizers for yellow image dyes has additionally been described in detail in, e.g., DE 4,307,439, DE 4,320,828, EP 0 508 398, EP 0 538 862, U.S. Pat. Nos. 5,294,530, 5,426,021, 5,441,855, 5,441,861, 5,466,569, 5,891,613, and WO 91/008,515. Further advantages are claimed for the combination of such bisphenol stabilizers with certain spirocyclic compounds in U.S. Pat. No. 5,567,578. U.S. Pat. No. 5,284,742 describes the combination of certain yellow couplers with alkylated quinone type stabilizers and phenolic stabilizers for improved color reproduction and light stability. U.S. Pat. No. 5,091,294 describes the combination of certain yellow couplers with thiane stabilizers for improved color reproduction and light stability. EP 0 310 552 describes the use of thiane derivatives combined with yellow dye-forming couplers and phenolic antioxidants for improved light stability. U.S. Pat. No. 5,935,773 describes the combination yellow couplers with cyclo-dextrans and phenolic stabilizers for improved color reproduction and light stability. However, there remains a continuing need to seek coupler formulations with improved performance because, quite often, one or more of the other desirable properties of the photographically formed dye (such as its hue or its efficiency of formation) can be affected adversely by these artifices.

U.S. Pat. Nos. 5,017,465 and 5,082,766 and German Published Patent Application DTOS 4,307,194 describe the use of certain stabilizers with pyrazoloazole magenta dye forming couplers to improve their dye stability. One class of stabilizers which is disclosed includes compounds of the following structure:

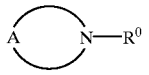

wherein A represents a group of non-metal atoms necessary to complete a 5-membered to 8-membered nitrogen-containing ring and $R^0$ represents an aryl group or a heterocyclic group. Preferred compounds of such formula as described in U.S. Pat. No. 5,017,465 include compounds wherein A represents the atoms necessary to complete a thiomorpholine 1,1-dioxide group and where $R^0$ represents an alkoxy substituted phenyl group. Such compounds are believed to stabilize by acting as singlet oxygen quenchers. U.S. Pat Nos. 5,236,819 and 5,561,037 disclose that the light stability of the image dyes from such cyclic azole magenta couplers can be further improved by the use of a combination of stabilizers which include thiomorpholine dioxide compounds, U.S. Pat. Nos. 5,561,037 disclosing the use of substituted sulfonamido phenyl compounds in such combinations. The utility of thiomorpholine dioxide stabilizers in relation to 2-equivalent pyrazolone magenta couplers is also disclosed in U.S. Pat. Nos. 5,491,054 and 5,484,696.

SUMMARY OF THE INVENTION

An objective of this invention is to provide photographic elements which exhibit exceptional yellow dye light stability, and which retain desirable properties derived from the use of acetanilide-based yellow dye-forming couplers. A further objective of the invention is to provide increased activity for photographic elements comprising acetanilide-based yellow dye-forming couplers.

In accordance with one embodiment of the invention, a photographic element is disclosed comprising a silver halide emulsion layer having associated therewith an acetanilide-based yellow dye forming coupler and a stabilizer compound of the formula S-I:

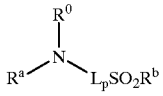

wherein $R^0$ represents an aryl or heterocyclic group;

$R^a$ is H or a substituent group;

L represents an alkylene linking group and p represents 0 or 1; and $R^b$ is a substituent group, provided that substituent groups represented by $R^a$ and $R^b$ may be joined to form a ring.

In accordance with preferred embodiments, $R^0$ represents a substituted phenyl group of the following formula:

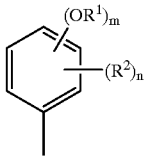

wherein m is 1, 2, 3, 4 or 5;

n is 0, 1, 2, 3, or 4, provided that the sum of m and n is less than or equal to 5; and $R^1$ is H or a substituent group and $R^2$ is a substituent group, provided that substituent groups represented by $R^1$ and $R^2$ or two $R^1$ or two $R^2$ groups may be joined to form a ring.

In accordance with most preferred embodiments, $R^0$ represents a para-substituted phenyl group of the formula:

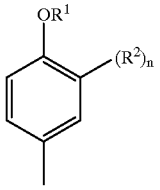

where n is 0 or 1.

We have found that the objectives of the invention can be achieved with acetanilide-based couplers through the use of substituted amine compounds of formula S-I as stabilizing addenda, particularly when used in combination with known substituted phenolic stabilizers. Unexpected and substantial improvements in the light stability of the image dyes can be obtained, and, furthermore, the presence of the amine compound improves the efficiency of the dye formation reaction. Accordingly, photographic elements of the present invention upon exposure and photographic processing exhibit good activity and yield yellow dye images that have low fading when exposed to light.

DETAILED DESCRIPTION OF THE INVENTION

As used herein, unless otherwise indicated the alkyl and aryl groups, and the alkyl and aryl portions of groups, can be unsubstituted or substituted with non-interfering substituents. Typical alkyl groups have 1 to 32 carbon atoms and typical aryl groups have 6 to 32 carbon atoms. Depending upon the position of the group, preferred alkyl groups can have 1 to 20 carbon atom, 1 to 12 carbon atoms or 1 to 4 carbon atoms and preferred aryl groups can have 6 to 20 or 6 to 1 0 carbon atoms. Other groups identified below which contain a replaceable hydrogen atom can be substituted or not, depending on the particular structure and properties desired.

$R^0$ represents an aryl or heterocyclic group. Representative groups include phenyl, 1-naphthyl, 2-furyl and 2-thienyl, and pyridyl. In a preferred embodiment, $R^0$ represents a substituted phenyl group represented by the formula:

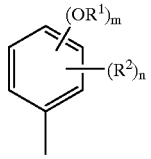

wherein m is 1, 2, 3, 4 or 5; n is 0, 1, 2, 3, or 4, provided that the sum of m and n is less than or equal to 5; and $R^1$ is H or a substituent group and $R^2$ is a substituent group, provided that substituent groups represented by $R^1$ and $R^2$ or two $R^1$ or two $R^2$ groups may be joined to form a ring.

$R^1$ preferably represents an alkyl group, a cycloalkyl group, an alkenyl group, an aryl group, a heterocyclic group, an acyl group, a bridged hydrocarbon group, an alkyl sulfonyl group or an aryl sulfonyl group. For $R^1$, the alkyl group may include, e.g., a straight-chain or branched-chain alkyl group having 1 to 24 carbon atoms; the cycloalkyl group, e.g., a cycloalkyl group having 5 to 24 carbon atoms; the alkenyl group, e.g., an alkenyl group having 3 to 24 carbon atoms; the aryl group, e.g., a phenyl group and naphthyl group; the heterocyclic group, e.g., a pyridyl group, an imidazolyl group and a thiazolyl group; the acyl group, e.g., an acetyl group and a benzoyl group; the bridged hydrocarbon group, e.g., a bicyclo[2.2.1]heptyl group, etc., respectively. $R^2$ may represent, e.g., a halogen atom or the groups such as alkyl, aryl, alkoxy, aryloxy, alkylthio, arylthio, acyl, alkoxycarbonyl, carbamoyl (e.g., alkylcarbamoyl, arylcarbamoyl), ureido (e.g., alkylureido, arylureido), sulfamoyl (e.g., alkylsulfamoyl, arylsulfamoyl), amino, alkylsulfonyl, arylsulfonyl, nitro, cyano and carboxy.

The —$OR^1$ substituent in the above formula is preferably located para to the amino substituent, and the —$R^2$ substituent (when present) is preferably located in either or both of the positions ortho to the —$OR^1$ substituent. In accordance with particularly preferred embodiments $R^0$ is represented by the formula:

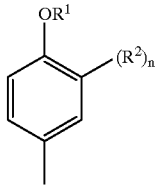

wherein n represents 0 or 1.

L represents an alkylene linking group and p represents 0 or 1. When present, L is preferably selected from alkylene groups having the formula —(C(R)(R))$_q$—, where q equals from 1 to 6, more preferably from I to 4, and most preferably 2, and each R may be independently H or an alkyl group, or two alkyl groups may be joined to form a hydrocarbon ring. Examples of such ring containing linking groups include the following:

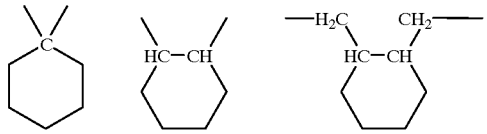

Most preferably, L when present represents an unsubstituted ethylene linking group.

$R^a$ is H or a substituent group, and $R^b$ is a substituent group, provided that substituent groups represented by $R^a$ and $R^b$ may be joined to form a ring. Examples of $R^a$ and $R^b$ substituent groups include those set forth for $R^1$ above. Preferably, $R^a$ and $R^b$ represent alkyl groups. In a particularly preferred embodiment of the invention, p is 1 and L, $R^a$ and $R^b$ combine together to complete a thiomorpholine dioxide group. In this embodiment, $R^1$ is preferably an unsubstituted or substituted alkyl group and n is preferably 0. When $R^a$ represents H, p preferably is 0 and $R^b$ preferably is an alkyl group of from 1 to 16 carbon atoms, and $R^1$ is preferably an unsubstituted or substituted alkyl group.

Specific stabilizer compounds of formula S-I which may be used within the scope of the present invention include the following structures:

S-I-1

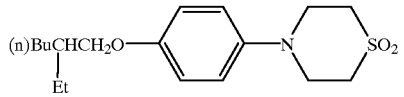

S-I-2

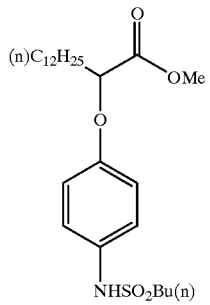

S-I-3

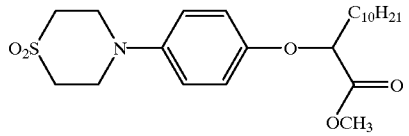

S-I-4

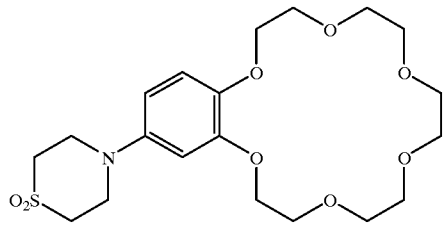

S-I-5

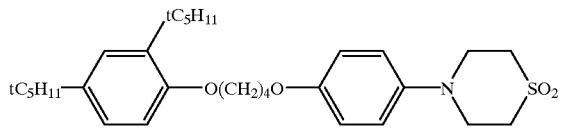

-continued
S-I-6
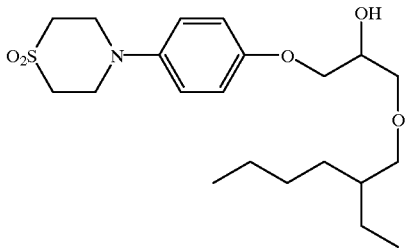
S-I-7
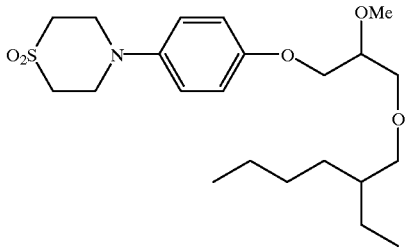
S-I-8
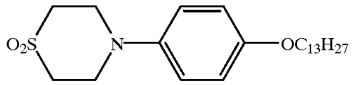
S-I-9
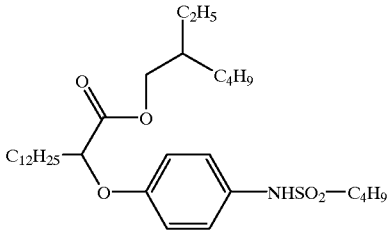
S-I-10
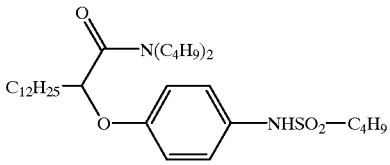
S-I-11
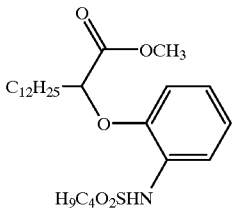
S-I-12
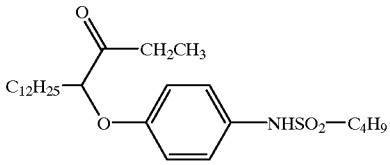

-continued

S-I-13

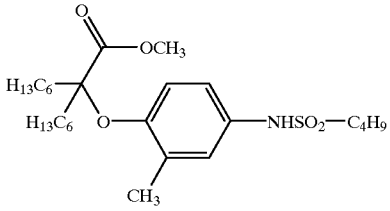

S-I-14

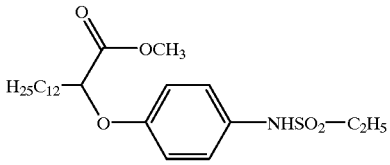

S-I-15

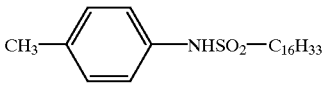

Compounds of formula S-I are known in the art (primarily for use as magenta dye stabilizers as discussed above), and may be formed, e.g., as disclosed in the above referenced U.S. Pat. Nos. 5,017,465, 5,082,766, 5,236,819, 5,484,696, 5,491,054, and 5,561,037.

The dye forming coupler compounds employed in the elements of the present invention are known compounds and can be prepared by techniques known to those skilled in the art. Individual yellow couplers may be used singly or in combinations. Couplers that form yellow dyes upon reaction with oxidized color developing agent and which are useful in elements of the invention are described in such representative patents and publications as: U.S. Pat. Nos. 2,875,057; 2,407,210; 3,265,506; 2,298,443; 3,048,194; 3,447,928 and "Farbkuppler—Eine Literature Ubersicht," published in Agfa Mitteilungen, Band III, pp. 112–126 (1961). Such couplers are typically open chain ketomethylene compounds. Also preferred are yellow couplers such as described in, for example, European Patent Application Nos. 482,552; 510,535; 524,540; 543,367; and U.S. Pat. No. 5,238,803.

Typical preferred acetanilide-based yellow couplers are represented by the following formulas:

YELLOW-1

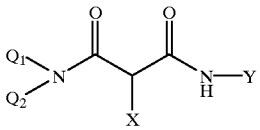

YELLOW-2

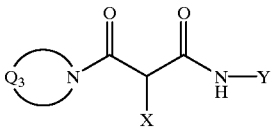

-continued

YELLOW-3

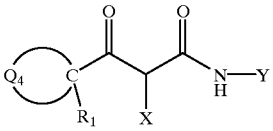

YELLOW-4

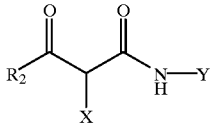

wherein $R_1$, $R_2$, $Q_1$ and $Q_2$ each represent a substituent; X is hydrogen or a coupling-off group; Y represents an aryl group or a heterocyclic group; $Q_3$ represents an organic residue required to form a nitrogen-containing heterocyclic group together with the illustrated nitrogen atom; and $Q_4$ represents nonmetallic atoms necessary to form a 3- to 5-membered hydrocarbon ring or a 3- to 5-membered heterocyclic ring which contains at least one hetero atom selected from N, O, S, and P in the ring. Preferred couplers are of YELLOW-1 and YELLOW4 wherein $Q_1$ and $Q_2$ each represent an alkyl group, an aryl group, or a heterocyclic group, and $R_2$ represents an aryl or alkyl group, including cycloalkyl and bridged cycloalkyl groups, and more preferably a tertiary alkyl group. Particularly preferred yellow couplers for use in elements of the invention are represented by YELLOW-4, wherein $R_2$ represents a tertiary alkyl group and Y represents an aryl group (particularly a phenyl group substituted with one or more groups selected from halogen, alkoxy, aryloxy, alkoxycarbonyl, alkyl- or aryl- amido, alkyl- or aryl- sulfonamido, alkyl- or aryl- carbamoyl, alkyl- or aryl- sulfamoyl, or alkyl- or aryl- sulfonyl, any of which may be further substituted) and X represents an aryloxy or N-heterocyclic coupling-off group. The elements of the invention are particularly useful in combination with yellow couplers of the above formulas wherein X represents a nitrogen-containing heterocyclic coupling-off group.

Representative yellow couplers which may be used in the elements of the invention include the following:

YC1
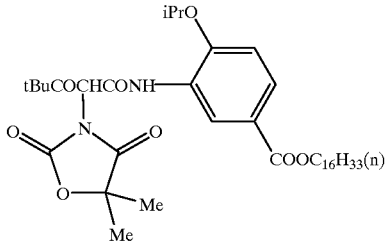
YC2
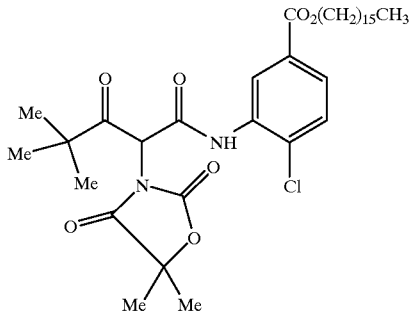
YC3
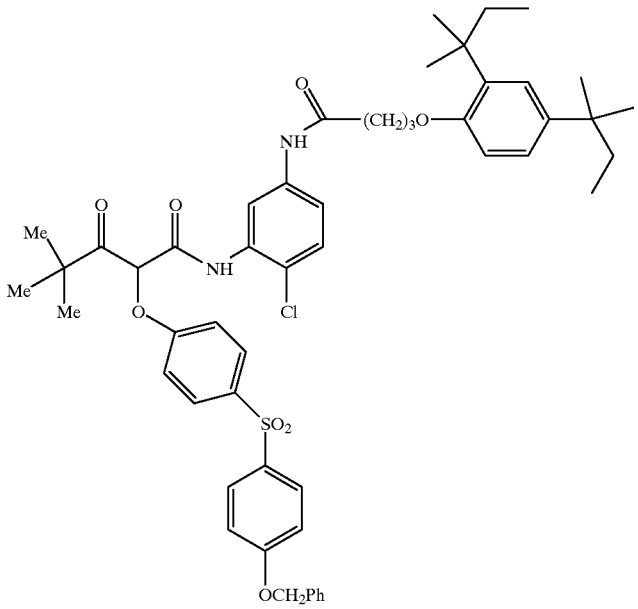
YC4
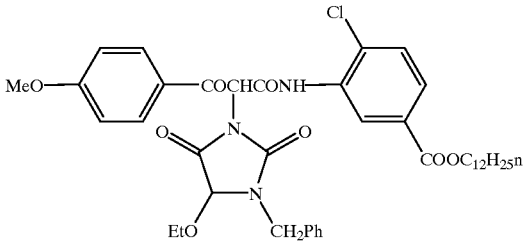

-continued
YC5
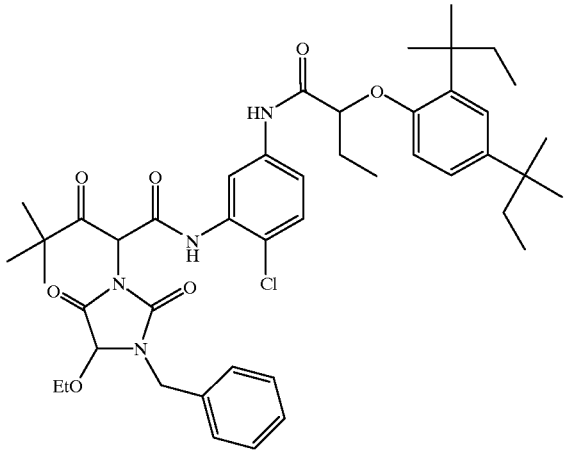
YC6
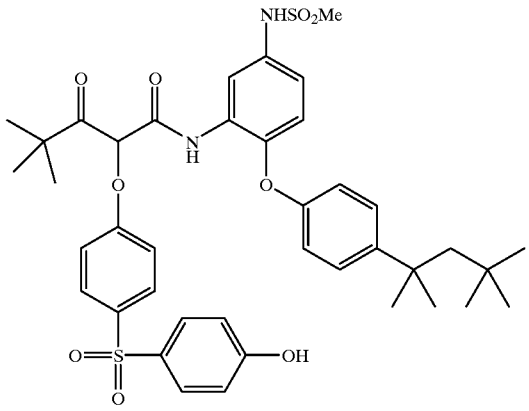
YC7
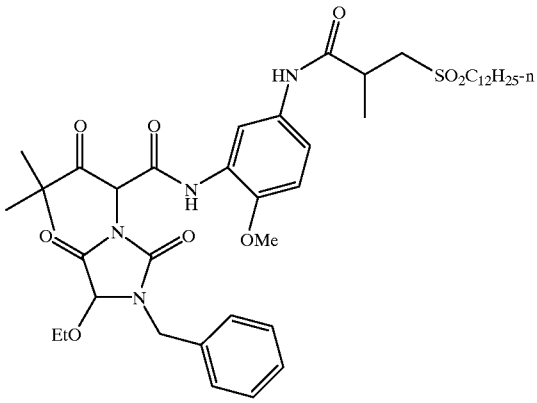
YC8
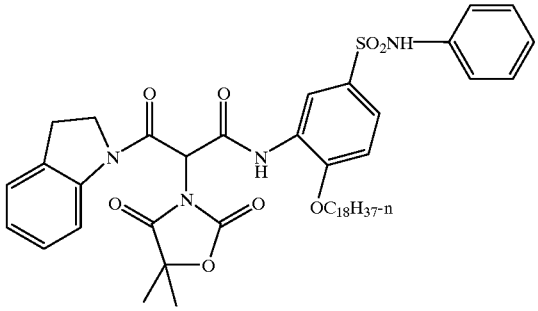

-continued
YC9
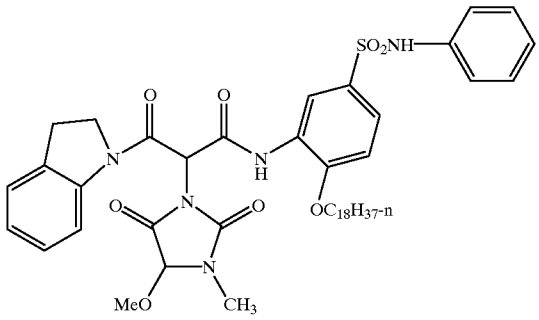
YC10
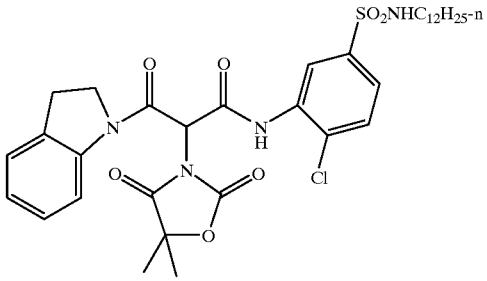
YC11
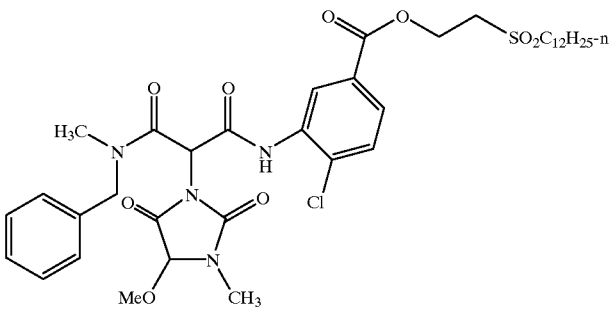
YC12
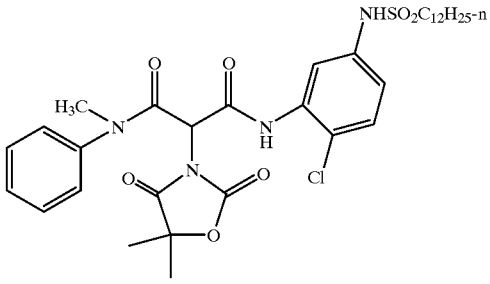

-continued
YC13
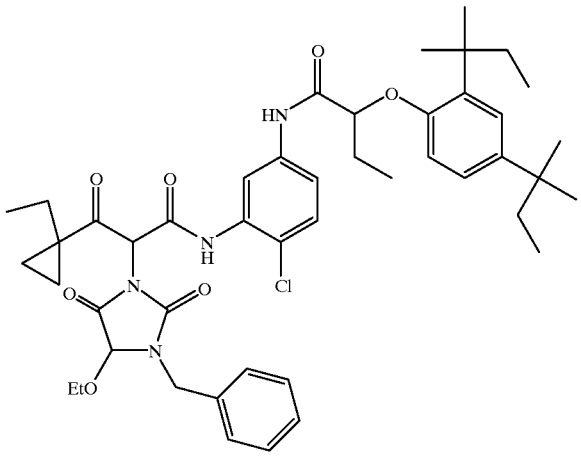
YC14
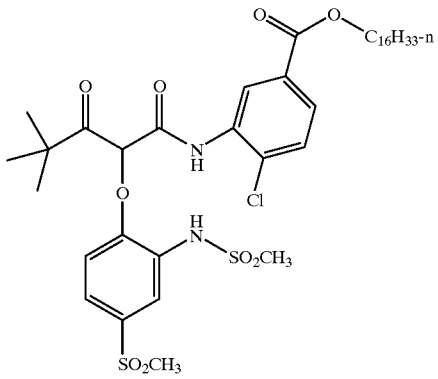
YC15
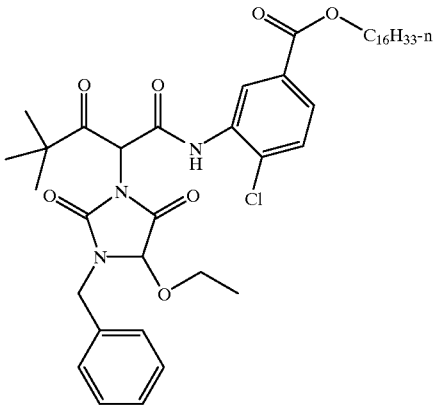

-continued

YC16

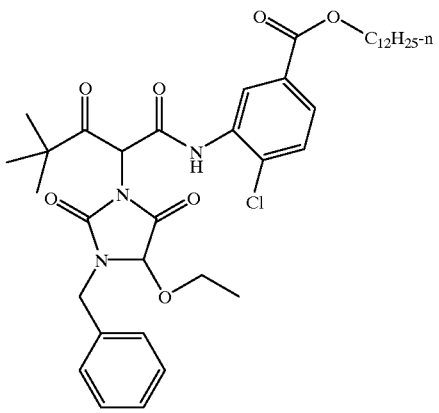

YC17

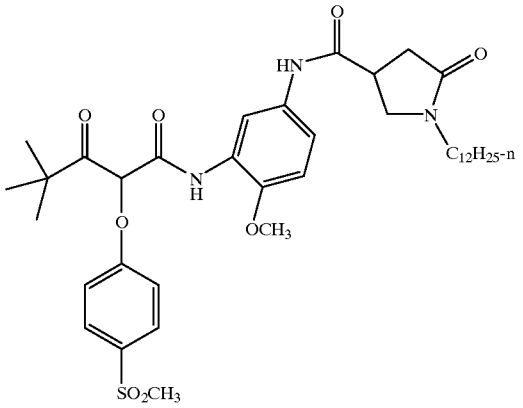

Typically, the couplers and the stabilizers with which they are associated are dispersed in the same layer of the photographic element in a permanent high boiling organic compound known in the art as a coupler solvent, either alone or with auxiliary low boiling or water miscible solvents which are removed after dispersion formation. Permanent high boiling solvents have a boiling point sufficiently high, generally above 150° C. at atmospheric pressure, such that they are not evaporated under normal dispersion making and photographic layer coating procedures. Alternatively, the couplers and stabilizers may be dispersed without permanent high boiling solvents using only auxiliary solvent or precipitation techniques as is known in the art. The compounds may be co-dispersed, or may be dispersed separately and then combined. Representative coupler solvents include phthalic acid alkyl esters such as diundecyl phthalate, dibutyl phthalate, bis-2-ethylhexyl phthalate, and dioctyl phthalate; phosphoric acid esters such as tricresyl phosphate, diphenyl phosphate, tris-2-ethylhexyl phosphate, and tris-3,5,5-trimethylhexyl phosphate; citric acid esters such as tributyl acetylcitrate, tributylcitrate and trihexylcitrate; 2-(2-butoxyethoxy)ethyl acetate; 1,4-cyclohexyldimethylene bis (2-ethylhexanoate); benzoic acid esters such as octyl benzoate; aliphatic amides such as N,N-diethyl lauramide, N,N-diethyldodecanamide, N,N-dibutyldodecanamide; mono and polyvalent alcohols such as oleyl alcohol and glycerin monooleate; and alkyl phenols such as p-dodecyl phenol and 2,4-di-t-butyl or 2,4-di-t-pentyl phenol. Commonly used coupler solvents are the phthalate esters, which can be used alone or in combination with one another or with other coupler solvents. Selection of the particular coupler solvent has been found to have an influence on the activity of the coupler as well as the hue and stability of the dye formed on coupling.

Typically the amount of compound S-I range from 0.05 to 2.0 moles stabilizer per mole of coupler, preferably from 0.1 to 1.0 moles stabilizer per mole of coupler. The yellow coupler is typically coated in the element at a coverage of from 0.25 mmol/$m^2$ to 2.0 mmol/$m^2$, and preferably at a coverage of from 0.40 to 1.2 mmol/$m^2$. When a coupler solvent is employed, it typically is present in an amount of 0.1 to 5.0 mg/mg coupler, and preferably in an amount of 0.25 to 2.0 mg/mg coupler.

To further enhance the stability of the yellow dyes formed in photographic elements in accordance with the invention, additional conventional stabilizing compounds may also be included. In accordance with a particularly preferred embodiment, the use of stabilizers of the formula S-I in combination with conventional substituted phenolic yellow dye stabilizers, and in particular substituted bisphenol based stabilizers, have been found to unexpectedly provide beneficial combinations of yellow coupler activity and formed dye light stability.

Substituted bisphenol light stabilizer compounds which may be used in accordance with preferred embodiments of the invention generally comprise bisphenol derivatives having two linked phenol rings wherein at least one of the phenol rings is substituted as described in the references cited above. Preferably, at least one of the phenolic hydroxy groups is also substituted with a blocking group. Such preferred blocked bisphenolic compounds are preferably of the following formula S-II:

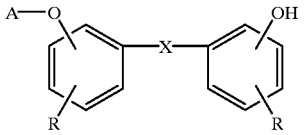

wherein A represents an alkyl (e.g., methyl, ethyl, propyl or butyl), cycloalkyl (e.g., cyclohexyl), alkenyl, aryl (e.g., phenyl), acyl (e.g., acetyl or benzoyl), alkylsulfonyl or arylsulfonyl group, X represents a single bond or a bivalent linking group (e.g., an alkylidene group such as methylene, butylidene, or 3,3,5-trimethylhexylidene, or a heteroatom such as oxygen, sulfur, selenium, or tellurium, or a sulfonyl or phosphinyl group), and each R independently represents one or more alkyl, alkenyl, cycloalkyl, or aryl group, such as described for A above, or in combination with the benzene ring to which it is attached represents the atoms necessary to complete a fused ring system. Each A, X and R group may be further substituted or unsubstituted. Specific examples of such blocked bisphenolic compounds, along with synthesis techniques, are disclosed, e.g., in U.S. Pat. Nos. 4,782,011 and 5,426,021, the disclosures of which are incorporated herein by reference. Additional substituted phenolic stabilizers which may be advantageously used in combination with the invention include those described in U.S. Pat. Nos. 5,091,294, 5,284,742, 5,935,773 and EP 0 310 551 and EP 0 310 552. When used in combination with stabilizers of the formula S-I, the substituted phenolic stabilizers may be used at similar concentrations. Preferably, the molar ratio of stabilizer compound of formula S-I to substituted phenolic light stabilizer compound is from I:12 to 25:1.

It is further contemplated to use the yellow coupler and stabilizer combinations of the invention in combination with polymeric stabilizers. Polymer containing dispersions of photographic couplers have been employed in photographic materials, as described, e.g., in U.S. Pat. Nos. 4,857,449; 5,001,045; 5,047,314; 5,055,386; 5,200,304; 5,242,788; 5,294,527, 5,558,980, 5,594,047, and 5,981,159. In a preferred embodiment, the yellow dye forming layer of photographic elements of the invention may include a copolymer (preferably 50:50 by weight) of t-butylacrylamide and n-butylacrylate.

Throughout this application a reference to any type of chemical "group" includes both the unsubstituted and substituted forms of the group described. Generally, unless otherwise specifically stated, substituent groups usable on molecules herein include any groups, whether substituted or unsubstituted, which do not destroy properties necessary for the photographic utility. It will also be understood throughout this application that reference to a compound of a particular general formula includes those compounds of other more specific formula which specific formula falls within the general formula definition. Examples of substituents on any of the mentioned groups can include known substituents, such as: halogen, for example, chloro, fluoro, bromo, iodo; alkoxy, particularly those with 1 to 6 carbon atoms (for example, methoxy, ethoxy); substituted or unsubstituted alkyl, particularly lower alkyl (for example, methyl, trifluoromethyl); alkenyl or thioalkyl (for example, methylthio or ethylthio), particularly either of those with 1 to 6 carbon atoms; substituted and unsubstituted aryl, particularly those having from 6 to 20 carbon atoms (for example, phenyl); and substituted or unsubstituted heteroaryl, particularly those having a 5 or 6-membered ring containing 1 to 3 heteroatoms selected from N, O, or S (for example, pyridyl, thienyl, furyl, pyrrolyl). Alkyl substituents may specifically include "lower alkyl", that is having from 1 to 6 carbon atoms, for example, methyl, ethyl, propyl, butyl, pentyl, hexyl. Further, with regard to any alkyl group, alkylene group or alkenyl group, it will be understood that these can be branched or unbranched and include ring structures.

The photographic elements of this invention can be chromogenic black and white elements utilizing combinations of dye-forming couplers, single color elements or multicolor elements. In addition to a yellow dye image forming hydrophilic colloid layer, the photographic elements in accordance with preferred embodiments of the invention further comprise at least one cyan image forming hydrophilic colloid layer and at least one magenta image forming layer. More particularly, multicolor photographic elements in accordance with preferred embodiments of the invention preferably comprise a support bearing light sensitive image dye forming layers sensitized to the blue (approx. 380–500 nm), green (approx. 500–600 nm), and red (approx. 600–760 nm) regions of the electromagnetic spectrum. In accordance with a preferred embodiment of the invention, the element comprises cyan, magenta and yellow dye forming silver halide emulsion hydrophilic colloid layer units sensitized to the red, green and blue regions of the spectrum. Each unit can comprise a single emulsion layer or multiple emulsion layers sensitive to a given region of the spectrum. The layers of the element, including the layers of the image forming units, can be arranged in various orders as known in the art. It is within the scope of this invention, however, for the light sensitive material to alternatively or additionally be sensitive to one or more regions of the electromagnetic spectrum outside the visible, such as the infrared region of the spectrum. In most color photographic systems, color-forming couplers are incorporated in the light-sensitive photographic emulsion layers so that during development, they are available in the emulsion layer to react with the color developing agent that is oxidized by silver halide image development. Non-diffusing couplers are incorporated in photographic emulsion layers. When the dye image formed is to be used in situ, couplers are selected which form non-diffusing dyes. Color photographic systems can also be used to produce black-and-white images from non-diffusing couplers as described, e.g., by Edwards et al. in International Publication No. WO 93/012465.

Image dye forming couplers may be included in elements of the invention such as couplers that form cyan dyes upon reaction with oxidized color developing agents which are described in such representative patents and publications as: U.S. Pat. Nos. 2,367,531; 2,423,730; 2,474,293; 2,772,162; 2,895,826; 3,002,836; 3,034,892; 3,041,236; 4,883,746 and "Farbkuppler—Eine Literature Ubersicht," published in Agfa Mitteilungen, Band III, pp. 156–175 (1961). Preferably such couplers are phenols and naphthols that form cyan dyes on reaction with oxidized color developing agent. Also preferable are the cyan couplers described in, for instance, European Patent Application Nos. 544,322; 556,700; 556,777; 565,096; 570,006; and 574,948.

Typical cyan couplers are represented by the following formulas:

CYAN-1

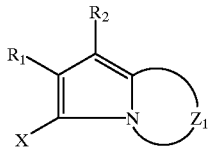

CYAN-2

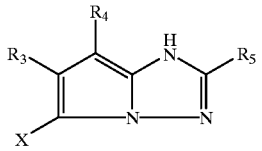

CYAN-3

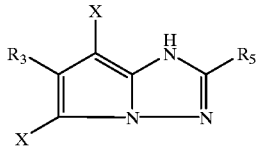

CYAN-4

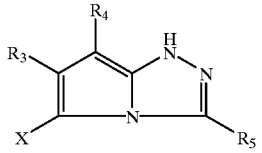

CYAN-5

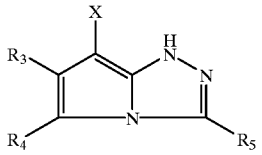

CYAN-6

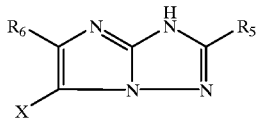

wherein $R_1$ and $R_5$ each represent a hydrogen or a substituent; $R_2$ represents a substituent; $R_3$ and $R_4$ each represent an electron attractive group having a Hammett's substituent constant $s_{para}$ of 0.2 or more and the sum of the $s_{para}$ values of $R_3$ and $R_4$ is 0.65 or more; $R_6$ represents an electron attractive group having a Hammett's substituent constant $s_{para}$of 0.35 or more; X represents a hydrogen or a coupling-off group; $Z_1$ represents nonmetallic atoms necessary for forming a nitrogen-containing, six-membered, heterocyclic ring which has at least one dissociative group. A dissociative group has an acidic proton, e.g. —N—, —CH(R)—, etc., that preferably has a pKa value of from 3 to 12 in water. The values for Hammett's substituent constants can be found or measured as is described in the literature (see, e.g., C. Hansch and A. J. Leo, *J. Med. Chem.,* 16, 1207 (1973); *J. Med. Chem.,* 20, 304 (1977); and J. A. Dean, *Lange's Handbook of Chemistry,* 12th Ed. (1979) (McGraw-Hill)).

More preferable are cyan couplers of the following formulas:

CYAN-7

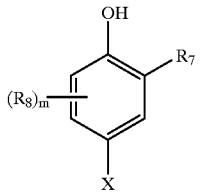

CYAN-8

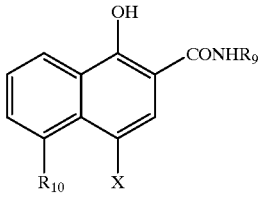

wherein $R_7$ represents a substituent (preferably a carbamoyl, ureido, or carbonamido group); $R_8$ represents a substituent (preferably individually selected from halogen, alkyl, and carbonamido groups); $R_9$ represents a ballast substituent; $R_{10}$ represents a hydrogen or a substituent (preferably a carbonamido or sulfonamido group); X represents a hydrogen or a coupling-off group; and m is from 1–3. Couplers of the structure CYAN-7 are most preferable for use in elements of the invention.

Couplers that form magenta dyes upon reaction with oxidized color developing agent which can be incorporated in elements of the invention are described in such representative patents and publications as: U.S. Pat. Nos. 2,600,788; 2,369,489; 2,343,703; 2,311,082; 2,908,573; 3,062,653; 3,152,896; 3,519,429 and "Farbkuppler—Eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents. Especially preferred couplers are 1H-pyrazolo[5,1-c]-1,2,4-triazole and 1H-pyrazolo[1,5-b]-1,2,4-triazole. Examples of 1H-pyrazolo[5,1-c]-1,2,4-triazole couplers are described in U.K. Patent Nos. 1,247,493; 1,252,418; 1,398,979; U.S. Pat. Nos. 4,443,536; 4,514,490; 4,540,654; 4,590,153; 4,665,015; 4,822,730; 4,945,034; 5,017,465; and 5,023,170. Examples of 1H-pyrazolo[1,5-b]-1,2,4-triazoles can be found in European Patent Applications 176,804; 177,765; U.S. Pat. Nos. 4,659,652; 5,066,575; and 5,250,400.

Typical pyrazoloazole and pyrazolone couplers are represented by the following formulas:

MAGENTA-1

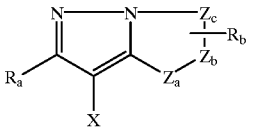

MAGENTA-2

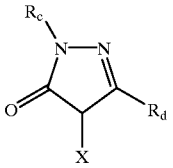

wherein $R^a$ and $R^b$ independently represent H or a substituent; $R_c$ is a substituent (preferably an aryl group); $R_d$ is a substituent (preferably an anilino, carbonamido, ureido, carbamoyl, alkoxy, aryloxycarbonyl, alkoxycarbonyl, or N-heterocyclic group); X is hydrogen or a coupling-off group; and Z*a*, Z*b*, and Z*c* are independently a substituted methine group, =N—, =C—, or —NH—, provided that one of either the Z*a*—Z*b* bond or the Z*b*—Z*c* bond is a double bond and the other is a single bond, and when the Z*b*—Z*c* bond is a carbon-carbon double bond, it may form part of an aromatic ring, and at least one of Z*a*, Z*b*, and Z*c* represents a methine group connected to the group $R^b$.

To obtain a satisfactory color and tonal balance as photographic images fade on exposure to light, it is important to achieve a balanced rate of density loss from yellow, magenta and cyan dyes. It is particularly desirable to produce a balanced rate of yellow and magenta dye loss in order to maintain a pleasing reproduction of skin tones. In accordance with preferred embodiments of the invention, a balanced rate of fade can be achieved using a yellow dye-forming layer comprising a stabilizer combination in accordance with preferred embodiments of this invention in combination with a magenta dye-forming coupler layer comprising highly-stable pyrazolotriazole coupler.

The yellow, cyan and magenta dye forming couplers that may be used in the elements of the invention can be defined as being 4-equivalent or 2-equivalent depending on the number of atoms of $Ag^+$ required to form one molecule of dye. A 4-equivalent coupler can generally be converted into a 2-equivalent coupler by replacing a hydrogen at the coupling site with a different coupling-off group. Coupling-off groups are well known in the art. Such groups can modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, alkylthio (such as mercaptopropionic acid), arylthio, phosphonyloxy and arylazo. These coupling-off groups are described in the art, for example, in U.S. Pat. Nos. 2,455,169; 3,227,551; 3,432,521; 3,476,563; 3,617,291; 3,880,661; 4,052,212 and 4,134,766; and in U.K. Patents and published Application Nos. 1,466,728; 1,531,927; 1,533,039; 2,006,755A and 2,017,704A, the disclosures of which are incorporated herein by reference.

To control the migration of various components coated in a photographic layer, including couplers, it may be desirable to include a high molecular weight hydrophobe or "ballast" group in the component molecule. Representative ballast groups include substituted or unsubstituted alkyl or aryl groups containing 8 to 40 carbon atoms. Representative substituents on such groups include alkyl, aryl, alkoxy, aryloxy, alkylthio, hydroxy, halogen, alkoxycarbonyl, aryloxycarbonyl, carboxy, acyl, acyloxy, amino, anilino, carbonamido (also known as acylamino), carbamoyl, alkylsulfonyl, arylsulfonyl, sulfonamido, and sulfamoyl groups wherein the substituents typically contain 1 to 40 carbon atoms. Such substituents can also be further substituted. Alternatively, the molecule can be made immobile by attachment to polymeric backbone.

Photographic elements of this invention can have the structures and components shown on Research Disclosure, February 1995, Item 37038, pages 79–114. Research Disclosure is published by Kenneth Mason Publications, Ltd., Dudley Annex, 12a North Street, Emsworth, Hampshire P01 7DQ, ENGLAND. Specific elements can be those shown on pages 96–98 of this Research Disclosure item as Color Paper Elements 1 and 2, in which is employed in the yellow dye forming layers the stabilizer combinations of the present invention instead of the stabilizers shown there. A typical multicolor photographic element of this invention comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, and subbing layers. All of these can be coated on a support which can be transparent or reflective (for example, a paper support). Photographic elements of the present invention may also usefully include a magnetic recording material as described in *Research Disclosure*, Item 34390, November 1992, or a transparent magnetic recording layer such as a layer containing magnetic particles on the underside of a transparent support as in U.S. Pat. Nos. 4,279,945 and U.S. Pat. Nos. 4,302,523. The element typically will have a total thickness (excluding the support) of from 5 to 30 micrometers. While the order of the color sensitive layers can be varied, they will normally be red-sensitive, green-sensitive and blue-sensitive, in that order on a transparent support, (that is, blue sensitive furthest from the support) and the reverse order on a reflective support being typical.

This invention also contemplates the use of photographic elements of the present invention in what are often referred to as single use cameras (or "film with lens" units). These cameras are sold with film preloaded in them and the entire camera is returned to a processor with the exposed film remaining inside the camera. Such cameras may have glass or plastic lenses through which the photographic element is exposed.

In the following discussion of suitable materials for use in elements of this invention, reference will be made to *Research Disclosure*, September 1994, Number 365, Item 36544, which will be identified hereafter by the term "Research Disclosure I." The Sections hereafter referred to are Sections of the Research Disclosure I.

The silver halide emulsions employed in the elements of this invention can be either negative-working, such as surface-sensitive emulsions or unfogged internal latent image forming emulsions, or direct positive emulsions of the unfogged, internal latent image forming type which are positive-working when development is conducted with uniform light exposure or in the presence of a nucleating agent. Suitable emulsions and their preparation as well as methods of chemical and spectral sensitization are described in Sections I through V. Color materials and development modifiers are described in Sections V through XX. Vehicles which can be used in the elements of the present invention are described in Section II, and various additives such as brighteners, antifoggants, stabilizers, light absorbing and scattering materials, hardeners, coating aids, plasticizers, lubricants and matting agents are described, for example, in Sections VI through X and XI through XIV. Manufacturing methods are described in all of the sections, other layers and supports in Sections XI and XIV, processing methods and agents in Sections XIX and XX, and exposure alternatives in Section XVI.

With negative-working silver halide a negative image can be formed. Optionally a positive (or reversal) image can be formed although a negative image is typically first formed.

The photographic elements of the present invention may also use colored couplers (e.g. to adjust levels of interlayer correction) and masking couplers such as those described in EP 213 490; Japanese Published Application 58–172,647; U.S. Pat. No. 2,983,608; German Application DE 2,706,117; U.K. Patent 1,530,272; Japanese Application A-1 13935; U.S. Pat. No. 4,070,191 and German Application DE 2,643, 965. The masking couplers may be shifted or blocked.

The photographic elements may also contain materials that accelerate or otherwise modify the processing steps of bleaching or fixing to improve the quality of the image. Bleach accelerators described in EP 193 389; EP 301 477; U.S. Pat Nos. 4,163,669; 4,865,956; and 4,923,784 are particularly useful. Also contemplated is the use of nucleating agents, development accelerators or their precursors (UK Patent 2,097,140; U.K. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g. as described in U.S. Pat. No. 4,366,237; EP 096 570; U.S. Pat. Nos. 4,420,556; and 4,543,323.) Also, the couplers may be blocked or coated in protected form as described, for example, in Japanese Application 61/258,249 or U.S. Pat. No. 5,019,492.

The photographic elements may further contain other image-modifying compounds such as developer inhibitor releasing compounds (DIR's).

The elements of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. Nos. 4,346, 165; 4,540,653 and 4,906,559); with ballasted chelating agents such as those in U.S. Pat. No. 4,994,359 to reduce sensitivity to polyvalent cations such as calcium; and with stain reducing compounds such as described in U.S. Pat. Nos. 5,068,171 and 5,096,805. Other compounds useful in the elements of the invention are disclosed in Japanese Published Patent Applications 83/09,959; 83/62,586; 90/072,629, 90/072,630; 90/072,632; 90/072,633; 90/072, 634; 90/077,822; 901078,229; 90/078,230; 90/079,336; 90/079,338; 90/079,690; 90/079,691; 90/080,487; 90/080, 489; 90/080,490; 90/080,491; 90/080,492; 90/080,494; 90/085,928; 90/086,669; 90/086,670; 90/087,361; 90/087, 362; 90/087,363; 90/087,364; 90/088,096; 90/088,097; 90/093,662; 90/093,663; 90/093,664; 90/093,665; 90/093, 666; 90/093,668; 90/094,055; 90/094,056; 90/101,937; 90/103,409; 90/151,577.

The silver halide grains to be used in the invention may be prepared according to methods known in the art, such as those described in *Research Disclosure I* and James, *The Theory of the Photographic Process*. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, and pH values at suitable values during formation of the silver halide by precipitation.

The silver halide to be used in the invention may be advantageously subjected to chemical sensitization with noble metal (for example, gold) sensitizers, middle chalcogen (for example, sulfur) sensitizers, and reduction sensitizers. Compounds and techniques useful for chemical sensitization of silver halide are known in the art and described in *Research Disclosure I* and the references cited therein.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin), and others as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, and methacrylamide copolymers, as described in *Research Disclosure I*. The vehicle can be present in the emulsion in any amount useful in photographic emulsions. The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30 to 80° C., as illustrated in *Research Disclosure*, June 1975, item 13452 and U.S. Pat. No. 3,772,031.

The silver halide may be sensitized by sensitizing dyes by any method known in the art, such as described in *Research Disclosure I*. The dye may be added to an emulsion of the silver halide grains and a hydrophilic colloid at any time prior to (e.g., during or after chemical sensitization) or simultaneous with the coating of the emulsion on a photographic element. The dye/silver halide emulsion may be mixed with a dispersion of color image-forming coupler immediately before coating or in advance of coating (for example, 2 hours).

Photographic elements of the present invention are preferably imagewise exposed using any of the known techniques, including those described in *Research Disclosure I*, section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT).

Photographic elements comprising the composition of the invention can be processed in any of a number of well-known photographic processes utilizing any of a number of well-known processing compositions, described, for example, in *Research Disclosure I*, or in T. H. James, editor, *The Theory of the Photographic Process,* 4th Edition, Macmillan, New York, 1977. In the case of processing a negative-working element, the element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog unexposed silver halide (usually chemical or light fogging), followed by treatment with a color developer. Preferred color developing agents are p-phenylenediamines. Especially preferred are: 4-amino-N,N-diethylaniline hydrochloride, 4-amino-3-methyl-N,N-diethylaniline hydrochloride, 4-amino-3-methyl-N-ethyl-N-(β-(methanesulfonamido)ethylaniline sesquisulfate hydrate, 4-amino-3-methyl-N-ethyl-N-(β-hydroxyethyl)aniline sulfate, 4-amino-3β-(methanesulfonamido)ethyl-N,N-diethylaniline hydrochloride and 4-amino-N-ethyl-N-(2-methoxyethyl)-m-toluidine di-p-toluene sulfonic acid.

Development is followed by bleach-fixing, to remove silver or silver halide, washing and drying. Bleaching and fixing can be performed with any of the materials known to be used for that purpose. Bleach baths generally comprise an aqueous solution of an oxidizing agent such as water soluble salts and complexes of iron (III)(e.g., potassium ferricyanide, ferric chloride, ammonium or potassium salts of ferric ethylenediaminetetraacetic acid), water-soluble persulfates (e.g., potassium, sodium, or ammonium persulfate), water-soluble dichromates (e.g., potassium, sodium, and lithium dichromate), and the like. Fixing baths generally comprise an aqueous solution of compounds that form soluble salts with silver ions, such as sodium thiosulfate, ammonium thiosulfate, potassium thiocyanate, sodium thiocyanate, thiourea, and the like.

The photographic elements comprising stabilizers in accordance with this invention may be processed in amplification processes that use developer/amplifier solutions described in U.S. Pat. No. 5,324,624, for example. When processed in this way, the low volume, thin tank processing system and apparatus described in U.S. Pat. 5,436,118 preferably is employed.

EXAMPLES

The following examples further illustrate this invention. In such examples, acetanilide-based yellow couplers of the above structures YC-1 though YC-4 are employed. Also, in addition to various compounds of formula S-I above, yellow stabilizers YSt-1 through YSt-7 are employed:

YSt-1

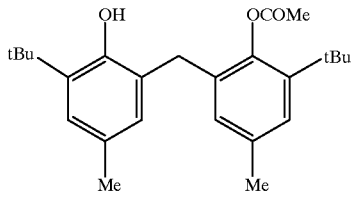

YSt-2

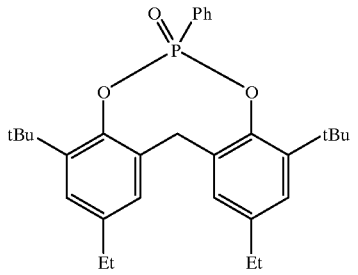

YSt-3

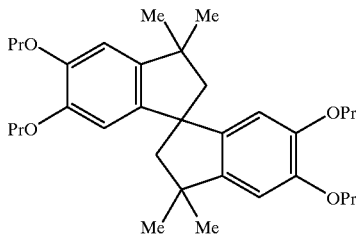

-continued
YSt-4
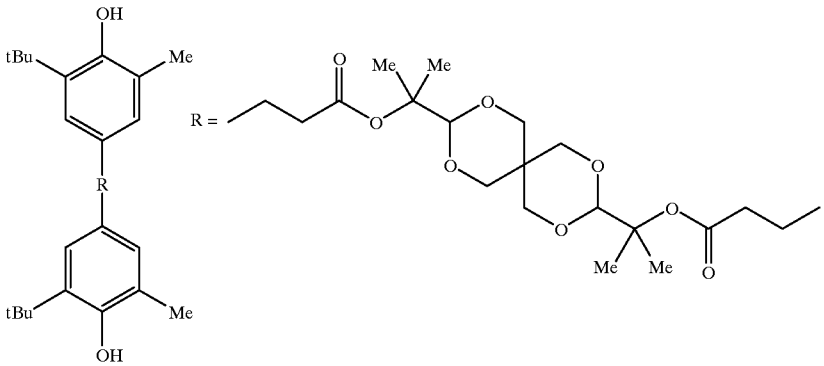
YSt-5
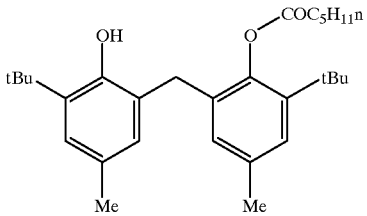
YSt-6
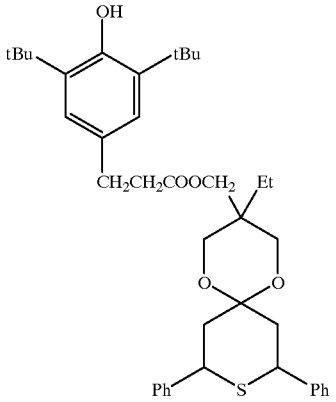
YSt-7
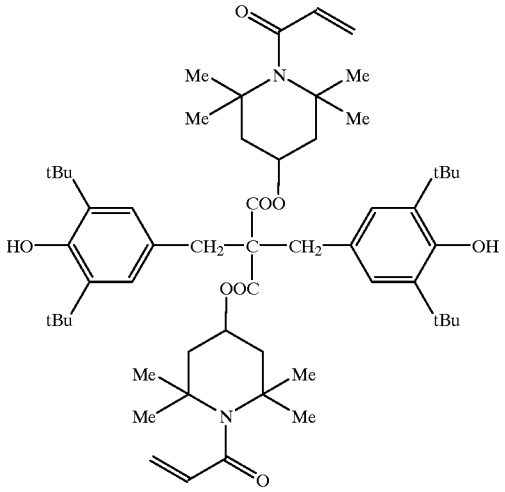

Example 1

Dispersion I was prepared by dissolving coupler YC1 (5.63 g, 8.38 mmol) in a mixture of di-n-butyl phthalate (1.86 g) and ethyl acetate (2.0 g). The hot oil phase solution was mixed with aqueous gelatin (40 g, 10.9%) which also contained 0.25% of di-isopropyl-naphthalene-sulfonic acid (sodium salt). The gelatin was held at 40° C. prior to mixing and the mixture was dispersed immediately, using ultrasonic agitation (Dawe Instruments "SONIPROBE"), for 2 min.

Further dispersions 2–10 were similarly prepared except that the stabilizers S-I-1 and S-I-2 in accordance with the invention and prior art yellow stabilizers YSt-1, YSt-2 and YSt-3 were mixed with the coupler in the oil phase solution, according to the schedule below The amounts of the other components in the oil phase were unaltered.

Dispersion Schedule

| Dispersion: | S-I-1 | S-I-2 | YSt-1 | YSt-2 | YSt-3 |
|---|---|---|---|---|---|
| 2 | 1.86 g | — | — | — | — |
| 3 | — | 1.86 g | — | — | — |
| 4 | — | — | 1.86 g | — | — |
| 5 | — | — | — | 1.86 g | — |
| 6 | — | — | — | — | 1.86 g |
| 7 | 0.93 g | — | 0.93 g | — | — |
| 8 | — | 0.93 g | 0.93 g | — | — |
| 9 | — | — | 0.93 g | 0.93 g | — |
| 10 | — | — | 0.93 g | — | 0.93 g |

Each of these coupler dispersions was diluted with further aqueous gelatin and mixed with a blue-sensitive cubic silver chloride photographic emulsion (average edge length: 0.76 μm) for coating on a resin-coated paper support, pre-coated with an unhardened gel pad. The mixing of the already molten components was carried out immediately prior to coating. A protective gel layer, which contained an appropriate quantity of bis-(vinylsulfonylmethyl) ether hardener, was coated over the photosensitive layer. The full coating structure is shown below (individual stabilizer coverages in the photosensitive layer are defined by the dispersion identity).

Sample strips of the coatings were exposed through a step tablet (density range 0–3, 0.15 inc.) and developed in standard Kodak RA4™ processing solutions before washing and drying.

Coating Structure
Resin Coated Paper

| | |
|---|---|
| GEL SUPERCOAT | |
| Gel | 1.615 $g.m^{-2}$ |
| Hardener* | 0.093 $g.m^{-2}$ |
| PHOTOSENSITIVE LAYER | |
| Coupler | 0.504 $g.m^{-2}$ |
| (Stabilizers | 0.166 $g.m^{-2}$) |
| DBP† | 0.166 $g.m^{-2}$ |
| Ag | 0.280 $g.m^{-2}$ |
| Gel | 1.615 $g.m^{-2}$ |
| GEL PAD | |
| Gel | 3.0 $g.m^{-2}$ |

*Hardener = bis(vinylsulfonylmethyl) ether
†DBP = dibutyl phthalate

Sensitometric curves were generated for each processed strip. The thermal stability of the image dyes was monitored in an accelerated dark keeping test at 75° C., 50%RH, while image dye light stability was assessed using standard simulated daylight fading equipment incorporating a Xenon arc source, delivering an exposure intensity of 50Klux at the sample plane. For the latter tests, sample strips were mounted in the fader under a uv-absorbing filter, comprising Tinuvin-328™ (Ciba), dispersed in gelatin and coated on a transparent polyester sheet at a coverage of 1.0 $g.m^{-2}$. At the end of these tests, the sensitometric curves were re-read and compared with the initial curves. Status "A" blue density changes from specified initial values were recorded. Selected results are reproduced in TABLE 1. In the table, coupling reactivity is represented by the figures in column 2, headed "0.4 Shoulder Density", which is used as a convenient monitor of upper scale contrast. It is obtained by recording the density achieved at an exposure 0.4 log (exposure) units greater than that required to produce a density of 0.8. Higher figures correspond to greater reactivity. Light stability is recorded in column 3, expressed as the measured density change from an initial density value of 1.0.

TABLE 1

Processed Coatings of Coupler YC1
4 wk. 50 klux Light Fade (+ uv Filter)

| Stabilizer(s) | | 0.4 Shoulder Density | Fade†[$\Delta D_{(1.0)}$] |
|---|---|---|---|
| None | (Dispn. 1) | 1.945 | −0.54 |
| S-I-1* | (Dispn. 2) | 2.013 | −0.32 |
| S-I-2* | (Dispn. 3) | 1.982 | −0.49 |
| YSt-1 | (Dispn. 4) | 1.854 | −0.17 |
| YSt-2 | (Dispn. 5) | 1.883 | −0.19 |
| YSt-3 | (Dispn. 6) | 1.917 | −0.38 |
| YSt-1 + S-I-1* | (Dispn. 7) | 1.927 | −0.13 |
| YSt-1 + S-I-2* | (Dispn. 8) | 1.938 | −0.17 |
| YSt-1 + YSt-2 | (Dispn. 9) | 1.850 | −0.17 |
| YSt-1 + YSt-3 | (Dispn. 10) | 1.819 | −0.13 |

*Stabilizers exemplifying this invention
†4 wk. 50 klux Light Fade. Density loss from an initial value of 1.0

The density figures in column 2 of Table 1 provide a direct indication of the efficiency of image dye generation in each coating, and show that the reference stabilizers YSt-1, YSt-2 and YSt-3 all inhibit dye formation, relative to the coating of coupler alone (dispersion 1). Stabilizer YSt-1 is particularly poor. However, both the stabilizers of this invention, S-I-1 and S-I-2, enhance dye formation. Moreover, stabilizers YSt-2 and YSt-3, when combined with stabilizer YSt-1, further reduce coupling activity, but combining stabilizer YSt-1 with either stabilizer of this invention (S-I-1 or S-I-2) gives a better response than obtained from YSt-1 alone, very nearly matching the activity of the unstabilized coating.

The results from the dye fade experiment show that all the stabilizing addenda improve the stability of the image dye from coupler YC1. When used alone, the reference stabilizers YSt-1 and YSt-2 are the most effective examples; the stabilizers S-I-1 and, especially, S-I-2 of this invention, display lower stabilizing activity, as does the comparison stabilizer YSt-3.

However, despite their relatively poor intrinsic stabilizing effectiveness, the two stabilizers of this invention, S-I-1 and S-I-2, perform remarkably well when used in combination with the reference stabilizer YSt-1. S-I-1 combines synergistically with YSt-1, providing greater stability than either stabilizer used alone, and is comparable in this respect with the comparison stabilizer YSt-3, which is known to provide a synergistic combination with stabilizers like YSt-1. Although S-I-2 does not exhibit the same synergism, neither does it degrade the effectiveness of YSt-1, which is a surprisingly good result for such an intrinsically poor stabilizer.

Example 2

A dispersion (designated 11) of coupler YC3 was prepared in a similar fashion to that described in Example 1, except that a high pressure mechanical homogeniser (Microfluidizer M11OF) was used instead of the ultrasonic technique described therein. The oil phase consisted of a blend of the coupler with the stabilizer YSt-1 (0.28×w/w cf coupler) dissolved in a mixture of dibutyl phthalate (0.33× w/w, cf coupler) and 2,(2-butoxyethoxy)ethyl acetate (0.33× w/w cf coupler), and the aqueous phase comprised a 10.6% gel solution containing di-isopropyl-naphthalene-sulfonic acid (sodium salt) (1%) and the polymeric surfactant Pluronic-L44™ (BASF) (1.8%). Component weights were chosen such that, after appropriate dilution, the finished dispersion contained 6% (w/w) of coupler and gelatin.

An additional six dispersions (12–17) were prepared in the same manner, except that stabilizer YSt-1 was replaced with various alternative stabilizers (or a combination thereof) as specified in the schedule below. The total weight of stabilizer remained constant in all these dispersions.

| Dispersion: | Stabilizer |
|---|---|
| 11 | YSt-1 |
| 12 | YSt-4 |
| 13 | S-I-1 |
| 14 | S-I-2 |
| 15 | S-I-1 + YSt-4 (1:1) |
| 16 | S-I-1 + YSt-1 (1:1) |
| 17 | S-I-2 + YSt-1 (1:1) |

The dispersions were mixed with a blue-sensitive iodochloride emulsion and coated in the format described in Example 1, except that an additional layer, containing the uv absorbing compounds Tinuvin-326™ and Tinuvin-328™ (Ciba), was included between the light sensitive layer and the supercoat. The uv-absorbers were incorporated as a co-dispersion prepared by the techniques described for coupler YC3 (above). To make the oil phase for this dispersion, the uv absorbers (in the required proportions) were dissolved in a mixture of dibutyl phthalate (0.166×w/w cf total uv absorber) and 1,4-cyclohexanedimethylene-bis-2-ethyl hexanoate (0.21×w/w cf total uv absorber). Component coverages were also varied in relation to Example 1, as indicated in the format below.

| Resin Coated Paper | |
|---|---|
| GEL SUPERCOAT | |
| Gel | 1.077 $g.m^{-2}$ |
| Hardener* | 0.149 $g.m^{-2}$ |
| UV SUPERCOAT | |
| Gel | 1.40 $g.m^{-2}$ |
| Tinuvin-326 ™ | 0.11 $g.m^{-2}$ |
| Tinuvin-328 ™ | 0.64 $g.m^{-2}$ |
| PHOTOSENSITIVE LAYER | |
| Gel | 1.66 $g.m^{-2}$ |
| Coupler | 0.73 $g.m^{-2}$ |
| (Stabilizers | 0.20 $g.m^{-2}$) |
| Ag | 0.27 $g.m^{-2}$ |

-continued

| Resin Coated Paper | |
|---|---|
| GEL PAD | |
| Gel | 3.23 $g.m^{-2}$ |

*Hardener = bis(vinylsulfonylmethane)

Sample strips were exposed, processed and evaluated as described in Example 1, except that the external uv-absorbing filter was not used in the light fade experiments. The results from the tests are shown in Table 2.

TABLE 2

Processed Coatings of Coupler YC3
4 wk. 50 klux Light Fade (No Filter)

| Dispersion Identity (Stabilizer Content) | 0.4 Shoulder Density | Fade† [$\Delta D_{(1.0)}$] |
|---|---|---|
| Dispn. 11 (YSt-1) | 1.70 | −0.41 |
| Dispn. 12 (YSt-4) | 1.76 | −0.36 |
| Dispn. 13 (S-I-1)* | 1.85 | −0.36 |
| Dispn. 14 (S-I-2)* | 1.87 | −0.44 |
| Dispn. 15 (S-I-1 + YSt-4)* | 1.84 | −0.30 |
| Dispn. 16 (S-I-1 + YSt-1)* | 1.86 | −0.27 |
| Dispn. 17 (S-I-2 + YSt-1)* | 1.84 | −0.39 |

*Stabilizer compositions exemplifying this invention
†4 wk. 50 klux Light Fade. Density loss from an initial value of 1.0

As revealed by the shoulder density figures in column 2 of Table 2, all the dispersions containing the inventive stabilizers S-I-1 and S-I-2, alone or in combination, provided enhanced coupling reactivity in comparison with the reference phenolic stabilizers YSt-1 and YSt-4. As was seen in Example 1, the reactivity advantage shown by S-I-1 and S-I-2 over the reference stabilizers YSt-1 and YSt-4 when the stabilizers are used independently is again retained in the blended stabilizer dispersions.

Stabilizers YSt-1 and YSt-4 are well-known in the art to provide useful improvements in yellow image dye light stability, and the fade data recorded in Table 2 demonstrate that, when used as a direct replacement for them, the inventive stabilizer S-I-1 compares favorably in performance with these previously-known materials (see dispersions 11, 12 and 13). However, even greater stability is obtained from dispersions 15 and 16, in which stabilizer S-I-1 is blended in equal proportion with one or other of the bis-phenolic stabilizers YSt-1 or YSt-4. Stabilizer S-I-2 of this invention is less effective than the other stabilizers shown in Table 2, but nevertheless also provides a small improvement in stability when used in combination with YSt-1 (dispersion 17).

It is clear that the combinations of the inventive stabilizers with the reference phenolic stabilizers provide better stability than can be obtained from either of the stabilizers used independently. Thus, the image dye light stability results recorded in Table 2 further demonstrate the benefits of dispersion formulations described in this invention, exemplified by the inventive stabilizers S-I-1 and S-I-2, either used alone or, more especially, in combination with a bis-phenol.

Example 3

A series of dispersions was prepared containing coupler YC2 blended with various stabilizers in a variety of coupler solvents. The specific stabilizer and solvent combinations are set out in the schedule below.

Dispersion Schedule

| Dispersion | Coupler | S-I-1 (g) | S-I-2 (g) | YSt-1 (g) | YSt-4 (g) | YSt-6 (g) | YSt-7 (g) | Solvent* (g) | Oil Temp |
|---|---|---|---|---|---|---|---|---|---|
| 21 | YC2 | | | | | | | Solv-1 | 110° C. |
| 22 | YC2 | | | 6.1 | | | | Solv-1 | 110° C. |
| 23 | YC2 | | | | 6.1 | | | Solv-1 | 110° C. |
| 24 | YC2 | | | | | 6.1 | | Solv-1 | 125° C. |
| 25 | YC2 | | | | | | 6.1 | Solv-1 | 150° C. |
| 26 | YC2 | 6.1 | | | | | | Solv-1 | 110° C. |
| 27 | YC2 | | 6.1 | | | | | Solv-1 | 110° C. |
| 28 | YC2 | 3.0 | | 3.0 | | | | Solv-1 | 110° C. |
| 29 | YC2 | | 3.0 | 3.0 | | | | Solv-1 | 110° C. |
| 30 | YC2 | 3.0 | | | | 3.0 | | Solv-1 | 125° C. |
| 31 | YC2 | 3.0 | | | | | 3.0 | Solv-1 | 125° C. |
| 32 | YC2 | | 3.0 | | | | 3.0 | Solv-1 | 110° C. |
| 33 | YC2 | 1.5 | 1.5 | 3.0 | | | | Solv-1 | 110° C. |
| 34 | YC2 | | | 12.1 | | | | Solv-1 | 110° C. |
| 35 | YC2 | 12.1 | | | | | | Solv-1 | 110° C. |
| 36 | YC2 | 6.1 | | 6.1 | | | | Solv-1 | 110° C. |
| 37 | YC2 | | | 6.1 | | | | Solv-2 | 110° C. |
| 38 | YC2 | 6.1 | | | | | | Solv-2 | 110° C. |
| 39 | YC2 | 3.0 | | 3.0 | | | | Solv-2 | 110° C. |
| 40 | YC2 | | | 6.1 | | | | Solv-4 | 110° C. |
| 41 | YC2 | 6.1 | | | | | | Solv-4 | 110° C. |
| 42 | YC2 | 3.0 | | 3.0 | | | | Solv-4 | 110° C. |
| 43 | YC2 | | | 6.1 | | | | Solv-5 | 110° C. |
| 44 | YC2 | 6.1 | | | | | | Solv-5 | 110° C. |
| 45 | YC2 | 3.0 | | 3.0 | | | | Solv-5 | 110° C. |
| 46 | YC2 | | | 6.1 | | | | Solv-6 | 110° C. |
| 47 | YC2 | 6.1 | | | | | | Solv-6 | 110° C. |
| 48 | YC2 | 3.0 | | 3.0 | | | | Solv-6 | 110° C. |

*Solv-1 = tributyl citrate
Solv-2 = tri-2-ethyl-hexyl phosphate
Solv-3 = dibutyl sebacate
Solv-4 = oleyl alcohol
Solv-5 = diundecyl phthalate
Solv-6 = phenyl ethyl benzoate Dispersion 21 was prepared by dissolving coupler YC2 (24.3 g) in tributyl citrate (Solv-1, 12.1 g) at 110° C. The hot oil phase solution was mixed with an 11.7% aqueous gelatin solution containing 0.94% di-isopropyl-naphthalene-sulfonic acid (sodium salt) at 80° C. (213.6 g). After mixing initially with a Brinkmann rotor-stator premixer at 8000 rev/min, the blend was passed twice through a Microfluidics Microfluidizer at 55.16 kPa (8000 psi) and 75° C.

Dispersion 22 was prepared in the same way except that stabilizer YSt-1 (6.1 g) was added to the oil solution and an equivalent quantity of water was removed from the gel solution to maintain the total dispersion weight at 250 g. Dispersions 23–48 were similarly prepared using the appropriate stabilizers (singly or in combination) and solvents, as set out in the schedule. The amounts of the coupler and solvent in the oil phase were kept constant and, where necessary, the amount of water in the gel phase was adjusted to maintain a total dispersion weight of 250 g. When stabilizers YSt-6 and YSt-7 were present it was sometimes necessary to increase the temperature of the hot oil to effect solution. The temperatures used are recorded in the schedule.

Portions of all these coupler dispersions were individually diluted with further aqueous gelatin and mixed with a blue-sensitive cubic silver iodo-chloride photographic emulsion for coating in the manner described in Example 2. The same basic coating structure was used, but with changes in the component coverages, as indicated in the structure below. Individual stabilizer coverages in the photosensitive layer are defined by the formulation of the coated dispersion.

Coating Structure
Resin Coated Paper

| | |
|---|---|
| GEL SUPERCOAT | |
| Gelatin | 1.077 $g.m^{-2}$ |
| Hardener* | 0.149 $g.m^{-2}$ |
| Alkanol XC | 1.7 $mg.m^{-2}$ |
| FT-248 | 0.5 $mg.m^{-2}$ |
| UV LAYER | |
| Gelatin | 1.399 $g.m^{-2}$ |
| Tinuvin-328 ™ | 0.510 $g.m^{-2}$ |
| Tinuvin-326 ™ | 0.090 $g.m^{-2}$ |
| PHOTOSENSITIVE LAYER | |
| Gelatin | 1.402 $g.m^{-2}$ |
| Coupler YC2 | 0.414 $g.m^{-2}$ |
| (Stabilizers | see TABLE 3a) |
| Ag | 0.215 $g.m^{-2}$ |
| GEL PAD | |
| Gelatin | 3.230 $g.m^{-2}$ |

*Hardener = bis(vinylsulfonylmethane)

Additionally, dispersions 24, 26, and 30 were also coated in a modification of the above format in which a 44 nm t-butylacrylamide/butylacrylate copolymer latex was included in the photosensitive layer in an amount suitable to produce a polymer coverage of 0.215 $g.m^{-2}$.

Sample strips were exposed, processed and evaluated as described in Example 2, except that light fade was continued for only 2 weeks and measurements were recorded from an initial density of 2.0 as well as 1.0. The results from the tests are shown in Tables 3a and 3b. Table 3a is confined to data pertaining to the coatings without the co-polymer latex, while Table 3b includes the data from the coatings with the latex.

The data in Table 3a show that the coating of dispersion 21, containing no stabilizer, exhibits poor light stability. Light stability is improved by the addition of the stabilizers YSt-1, YSt-4, YSt-6, or YSt-7 as shown in dispersions 22–25, but these reduce reactivity, as measured by the shoulder density. Dispersions 26 and 27, containing, respectively, the inventive stabilizers S-I-1 and S-I-2, also show improved light stability, although less than obtained from the comparative stabilizers YSt-1, YSt-4, YSt-5, or YSt-6, but reactivity is clearly better than shown by the latter stabilizers. The combinations of S-I-1 or S-1-2 with stabilizers YSt-1, YSt-6, or YSt-7 surprisingly give nearly the light stability obtainable with just using YSt-1, YSt-6, or YSt-7, but preserves the reactivity of the dispersion with no stabilizers. Stabilizer S-I-1 combined with stabilizer YSt-1 shows better light stability than obtained with either stabilizer alone, whereas the combinations of the comparison stabilizers YSt-6 or YSt-7 with S-1-1 give slightly lower stability than if YSt-6 or YSt-7 were used alone.

Comparing dispersions 34, 35, and 36 with dispersions 22, 26, and 28 shows that doubling the amount of the stabilizers improves light stability when using S-I-1 or YSt-1 on their own, but the combination is still preferable for maximum light stability and reactivity.

Dispersions 37–48 compare the use of the preferred inventive combination of stabilizers S-I-1 and YSt-1 with the use of both stabilizers alone, with various alternative coupler solvents to tributyl citrate (Solv-1). The combination in any solvent still enables high reactivity with high light stability. The light stability is best maximized by the use of Solv-1.

TABLE 3a

Processed Coatings of Dispersion 18 through 45

| Disp | Coupler | S-I-1 | S-I-2 | YSt-1 | YSt-4 | YSt-6 | YSt-7 | Solvent | 0.4 Shoulder Density | Fade† [$D_{(1.0)}$] | Fade‡ [$D_{(2.0)}$] | |
|---|---|---|---|---|---|---|---|---|---|---|---|---|
| 21 | YC2 | — | — | — | — | — | — | Solv-1 | 1.914 | −0.49 | −0.99 | Comp. |
| 22 | YC2 | — | — | 0.104 | — | — | — | Solv-1 | 1.874 | −0.16 | −0.28 | Comp. |
| 23 | YC2 | — | — | — | 0.104 | — | — | Solv-1 | 1.849 | −0.18 | −0.35 | Comp. |
| 24 | YC2 | — | — | — | — | 0.104 | — | Solv-1 | 1.879 | −0.14 | −0.34 | Comp. |
| 25 | YC2 | — | — | — | — | — | 0.104 | Solv-1 | 1.885 | −0.22 | −0.46 | Comp. |
| 26 | YC2 | 0.104 | — | — | — | — | — | Solv-1 | 1.928 | −0.35 | −0.73 | Inv. |
| 27 | YC2 | — | 0.104 | — | — | — | — | Solv-1 | 1.913 | −0.46 | −0.84 | Inv. |
| 28 | YC2 | 0.052 | — | 0.052 | — | — | — | Solv-1 | 1.900 | −0.14 | −0.34 | Inv. |
| 29 | YC2 | — | 0.052 | 0.052 | — | — | — | Solv-1 | 1.903 | −0.25 | −0.43 | Inv. |
| 30 | YC2 | 0.052 | — | — | — | 0.052 | — | Solv-1 | 1.906 | −0.20 | −0.44 | Inv. |
| 31 | YC2 | 0.052 | — | — | — | — | 0.052 | Solv-1 | 1.919 | −0.25 | −0.54 | Inv. |
| 32 | YC2 | — | 0.052 | — | — | — | 0.052 | Solv-1 | 1.896 | −0.28 | −0.54 | Inv. |
| 33 | YC2 | 0.026 | 0.026 | 0.052 | — | — | — | Solv-1 | 1.905 | * | −0.31 | Inv. |
| 34 | YC2 | — | — | 0.207 | — | — | — | Solv-1 | 1.831 | −0.12 | −0.20 | Comp. |
| 35 | YC2 | 0.207 | — | — | — | — | — | Solv-1 | 1.930 | −0.29 | −0.58 | Inv. |
| 36 | YC2 | 0.104 | — | 0.104 | — | — | — | Solv-1 | 1.912 | −0.09 | −0.17 | Inv. |
| 37 | YC2 | — | — | 0.104 | — | — | — | Solv-2 | 1.873 | −0.26 | −0.40 | Comp. |
| 38 | YC2 | 0.104 | — | — | — | — | — | Solv-2 | 1.929 | −0.58 | −1.11 | Inv. |
| 39 | YC2 | 0.052 | — | 0.052 | — | — | — | Solv-2 | 1.899 | −0.31 | −0.48 | Inv. |
| 40 | YC2 | — | — | 0.104 | — | — | — | Solv-4 | 1.822 | −0.37 | −0.58 | Comp |
| 41 | YC2 | 0.104 | — | — | — | — | — | Solv-4 | 1.893 | −0.73 | −1.38 | Inv. |
| 42 | YC2 | 0.052 | — | 0.052 | — | — | — | Solv-4 | 1.877 | −0.49 | −0.79 | Inv. |
| 43 | YC2 | — | — | 0.104 | — | — | — | Solv-5 | 1.848 | −0.22 | −0.39 | Comp. |
| 44 | YC2 | 0.104 | — | — | — | — | — | Solv-5 | 1.893 | −0.49 | −0.96 | Inv. |
| 45 | YC2 | 0.052 | — | 0.052 | — | — | — | Solv-5 | 1.869 | −0.22 | −0.44 | Inv. |
| 46 | YC2 | — | — | 0.104 | — | — | — | Solv-6 | 1.844 | −0.16 | −0.32 | Comp. |
| 47 | YC2 | 0.104 | — | — | — | — | — | Solv-6 | 1.888 | −0.41 | −0.82 | Inv. |
| 48 | YC2 | 0.052 | — | 0.052 | — | — | — | Solv-6 | 1.862 | −0.20 | −0.45 | Inv. |

†2 wk. 50 klux Fade. Density loss from an initial value of 1.0
‡2 wk. 50 klux Fade. Density loss from an initial value of 2.0

TABLE 3b

Processed Coatings with and without latex

| Disp | Coupler | S-I-1 | YSt-6 | Solvent | Latex | 0.4 Shoulder Density | Fade† [$D_{(1.0)}$] | Fade‡ [$D_{(2.0)}$] | |
|---|---|---|---|---|---|---|---|---|---|
| 24 | YC2 | — | 0.104 | Solv-1 | — | 1.879 | −0.14 | −0.34 | Comp. |
| 26 | YC2 | 0.104 | — | Solv-1 | — | 1.928 | −0.35 | −0.73 | Inv. |

TABLE 3b-continued

Processed Coatings with and without latex

| Disp | Coupler | S-I-1 | YSt-6 | Solvent | Latex | 0.4 Shoulder Density | Fade† [$D_{(1.0)}$] | Fade‡ [$D_{(2.0)}$] | |
|---|---|---|---|---|---|---|---|---|---|
| 30 | YC2 | 0.052 | 0.052 | Solv-1 | — | 1.906 | −0.20 | −0.44 | Inv. |
| 24 | YC2 | — | 0.104 | Solv-1 | 0.215 | 1.867 | −0.10 | −0.24 | Comp. |
| 26 | YC2 | 0.104 | — | Solv-1 | 0.215 | 1.958 | −0.17 | −0.40 | Inv. |
| 30 | YC2 | 0.052 | 0.052 | Solv-1 | 0.215 | 1.914 | −0.12 | −0.27 | Inv. |

†2 wk. 50 klux Light Fade. Density loss from an initial value of 1.0
‡2 wk. 50 klux Light Fade. Density loss from an initial value of 2.0

Referring to Table 3b, combining dispersions of the invention with a latex known to give improved light stability shows further advantage for light stability, without negatively affecting the reactivity.

Example 4

Dispersion 50 was prepared by dissolving coupler YC4 (17.0 g) and stabilizer YSt-1 (8.5 g) in tributyl citrate (Solv-1, 8.5 g) at 110° C. and adding the hot oil phase solution to a gelatin solution comprising gelatin (17.5 g) melted at 60° C. with a 1.13% aqueous solution of di-isopropyl-naphthalene-sulfonic acid (sodium salt) (123.5 g). After mixing using a Brinkmann rotor-stator premixer at 8000 rev/min, the blend was passed twice through a Microfluidics Microfluidizer at 55.16 kPa (8000 psi) and 75° C.

Dispersions 51 and 52 were prepared in the same manner as Dispersion 50, except that stabilizer YSt-1 was completely or partially replaced with stabilizer S-I-1, as indicated in the schedule below.

| Dispersion | Coupler | S-I-1 | YSt-1 | Solvent | Oil Temp |
|---|---|---|---|---|---|
| 50 | YC4 | | 8.4 | Solv-1 | 110° C. |
| 51 | YC4 | 8.4 | | Solv-1 | 110° C. |
| 52 | YC4 | 4.2 | 4.2 | Solv-1 | 110° C. |

Coatings of dispersions 50, 51 and 52 were prepared and evaluated as described in Example 3. Results are reported in Table 4.

TABLE 4

| Disp | Coupler | S-I-1 | YSt-1 | Solvent | 0.4 Shoulder Density | Fade† [$D_{(1.0)}$] | Fade‡ [$D_{(2.0)}$] | |
|---|---|---|---|---|---|---|---|---|
| 50 | YC4 | 0.000 | 0.207 | S-1 | 1.977 | −0.72 | −1.129 | Comp. |
| 51 | YC4 | 0.207 | 0.000 | S-1 | 2.081 | −0.72 | −1.417 | Inv. |
| 52 | YC4 | 0.104 | 0.104 | S-1 | 2.054 | −0.68 | −1.229 | Inv. |

†2 wk. 50 klux Light Fade. Density loss from an initial value of 1.0
‡2 wk. 50 klux Light Fade. Density loss from an initial value of 2.0

The dye formed from coupler YC4 is substantially less stable to light than dyes from YC2. Examination of data from higher densities shows that the preferred combination of the invention still enables high reactivity with more light stability than would be expected if the light fade properties of the stabilizers blended linearly.

Example 5

Four dispersions containing coupler YC2 blended with different stabilizer combinations (see below) were produced following the technique described in Example 3, using tributyl citrate (Solv-1) as the oil phase solvent. The relative proportions of coupler, stabilizer and solvent in the oil phase in these dispersions are shown in the table below. The weights of coupler and gelatin were chosen such that the concentrations of each in the finished dispersions were, respectively, 9.02% and 10.0%.

| Dispersion | YC2 | YSt-1/YSt-5* | S-I-1 | YSt-4 | Solv-1 |
|---|---|---|---|---|---|
| 61 | 1.0 | — | — | 0.292x | 0.526x |
| 62 | 1.0 | — | 0.292x | — | 0.526x |
| 63 | 1.0 | — | 0.292x | 0.292x | 0.526x |
| 64 | 1.0 | 0.292x | — | 0.292x | 0.526x |

*YSt-1/YSt-5 = mixture of YSt-1 (75%) with YSt-5 (25%)

A second series of five similar dispersions was also produced in the same manner, but in this case trihexyl citrate (Solv-7) was used as the coupler solvent. The stabilizer blends used in these dispersions are indicated below.

| Dispersion | YC2 | YSt-1/YSt-5* | S-I-1 | YSt-4 | Solv-7 |
|---|---|---|---|---|---|
| 65 | 1.0 | — | — | 0.146x | 0.526x |
| 66 | 1.0 | — | — | 0.292x | 0.526x |
| 67 | 1.0 | — | 0.146x | 0.146x | 0.526x |
| 68 | 1.0 | 0.292x | — | 0.292x | 0.526x |

*YSt-1/YSt-5 = mixture of YSt-1 (75%) with YSt-5 (25%)

Each of these dispersions was combined with a blue-sensitive chloro-iodide emulsion and coated as the first layer of a three-color photographic recording material on a resin-coated paper support. The subsequent layers were identical for all the coatings and consisted, in order, of a layer containing a scavenger for oxidized developer, a green imaging layer, a second scavenger layer, a red imaging layer, a uv absorbing layer and a protective gelatin super-coat. Details of the structure of the multilayer coating, including component coverages in each layer, are shown below.

In the coating structure, the green imaging layer consisted of a dispersion of coupler MC1 mixed with a green-sensitive iodo-chloride emulsion while a similar red-sensitized emulsion was mixed with a dispersion of coupler CC1 to form the red imaging layer.

The structures of the couplers MC1 and CC1 are shown below.

MC1

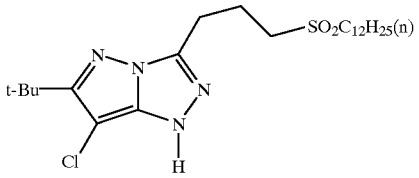

CC1

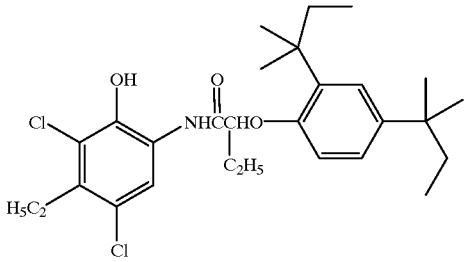

Coating structure

| | |
|---|---|
| Layer 7 (Supercoat) | |
| Ludox AM ® (DuPont) | 0.16 $g.m^{-2}$ |
| Gel | 0.645 $g.m^{-2}$ |
| Layer 6 (Interlayer C) | |
| Tinuvin-328 ® | 0.130 $g.m^{-2}$ |
| Tinuvin 326 ® | 0.023 $g.m^{-2}$ |
| DMBHQ | 0.042 $g.m^{-2}$ |
| Gel | 0.538 $g.m^{-2}$ |
| Layer 5 (Red-sensitive Layer) | |
| Ag | 0.19 $g.m^{-2}$ |
| Coupler CC1 | 0.35 $g.m^{-2}$ |
| Gel | 1.61 $g.m^{-2}$ |
| Layer 4 (Interlayer B) | |
| Tinuvin-328 ® | 0.172 $g.m^{-2}$ |
| Tinuvin 326 ® | 0.030 $g.m^{-2}$ |
| DMBHQ | 0.055 $g.m^{-2}$ |
| Gel | 0.71 $g.m^{-2}$ |
| Layer 3 (Green-sensitive Layer) | |
| Ag | 0.078 $g.m^{-2}$ |
| Coupler MC1 | 0.244 $g.m^{-2}$ |
| Gel | 1.42 $g.m^{-2}$ |
| Layer 2 (Interlayer A) | |
| DMBHQ | 0.066 $g.m^{-2}$ |
| Gel | 0.75 $g.m^{-2}$ |
| Layer 1 (Blue-sensitive Layer) | |
| Ag | 0.227 $g.m^{-2}$ |
| Coupler YC2 | 0.414 $g.m^{-2}$ |
| HQ-K | 0.0095 $g.m^{-2}$ |
| PHR | 0.0024 $g.m^{-2}$ |
| Latex copolymer | 0.413 $g.m^{-2}$ |
| Gel | 1.31 $g.m^{-2}$ |
| Hardener | 0.155 $g.m^{-2}$ |
| Support | |

PHR = 2,5-dihydroxy-5-methyl-3-(1-piperidenyl)-2-cyclopenten-1-one

-continued

MC1

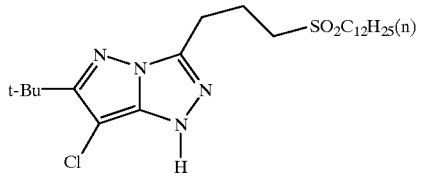

CC1

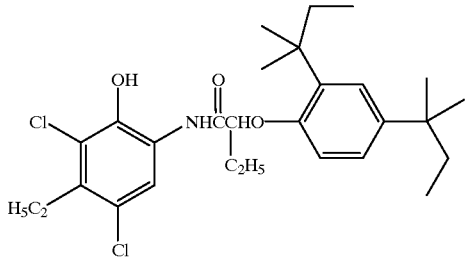

Coating structure

HQ-K = 2,5-dihydroxy-4-(1-methylheptadecyl)-benzenesulfonic acid (K salt)
Latex copolymer = 50/50 t-butylacrylamide/t-butylacrylate latex copolymer
DMBHQ = 2,5-di-(1,1,3,3-tetramethylbutyl)hydroquinone
Hardener = bis(vinylsulfonyl)methane The two uv absorbers, Tinuvin-326® and Tinuvin-328® were incorporated via the same co-dispersion outlined in Example 2, and the scavenger DMBHQ was also similarly incorporated in Interlayer A as a dispersion, prepared using the same techniques. For this dispersion, the scavenger was dissolved in dibutyl phthalate (3×, w/w cf scavenger).

The dispersions of MC1 and CC1 were prepared in the manner described for coupler YC2. The oil-phase compositions of these dispersions are shown below (the proportion of each component is quoted as a fraction of the coupler weight):

| | |
|---|---|
| Magenta | |
| Coupler MC1 | 1.0x |
| Stabilizer S-I-1 | 0.275x |
| Stabilizer S-I-2 | 1.88x |
| di-undecyl phthalate | 0.346x |
| Oleyl alcohol | 0.671x |
| Cyan | |
| Coupler CC1 | 1.0x |
| tri-o-cresyl phosphate | 1.70x |
| Tinuvin-328 ® (Ciba-Geigy) | 1.03x |
| 2,(2-butoxyethoxy)ethyl acetate | 0.219x |

Sample strips of the coatings were exposed to blue light (Wratten 98 filter) through a step tablet (density range 0–3, 0.15 increments) and developed in standard Kodak RA4 processing solutions before washing and drying. Sensitometry and light stability of the resultant yellow image were measured as described in Example 2, except that fading was continued for 5 weeks. The results are shown in Table 5.

TABLE 5

Processed Coatings Containing Coupler YC2

| Dispersion Identity | Stabilizer Content (fraction cf coupler) | Coupler Solvent | 0.4 Shoulder Density | Fade† [$\Delta D_{(1.0)}$] |
|---|---|---|---|---|
| 61 | YSt-4 (0.292x) | Solv-1 | 1.95 | −0.44 |
| 62* | S-I-1 (0.292x) | Solv-1 | 2.01 | −0.36 |
| 63* | S-I-1 (0.292x) + YSt-4 (0.292x) | Solv-1 | 1.99 | −0.25 |
| 64 | YSt-1/YSt-5 (0.292x) + YSt-4 (0.292x) | Solv-1 | 1.95 | −0.40 |
| 65 | YSt-4 (0.146x) | Solv-7 | 1.99 | −0.71 |
| 66 | YSt-4 (0.292x) | Solv-7 | 1.97 | −0.61 |
| 67* | S-I-1 (0.146x) + YSt-4 (0.146x) | Solv-7 | 2.00 | −0.50 |
| 68* | S-I-1 (0.292x) + YSt-4 (0.292x) | Solv-7 | 2.00 | −0.36 |
| 69 | YSt-1/YSt-5 (0.292x) + YSt-4 (0.292x) | Solv-7 | 1.96 | −0.47 |

*Stabilizer composition exemplifying this invention

†5 wk. 50 klux Light Fade. Blue density loss from an initial value of 1.0

Considering the first four entries in Table 5 (corresponding to coatings of dispersions with tributyl citrate coupler solvent) comparison between dispersions 61 and 62 shows that stabilizer S-I-1 of this invention is superior to the reference stabilizer YSt-4 in terms of both coupling reactivity and light stability. The good reactivity performance is maintained in the mixture of S-I-1 and YSt-4 (dispersion 63), and furthermore this mixture provides excellent light stability. In both respects, this coating is better than that of dispersion 64, which contains the same total stabilizer concentration, but made up of a mixture of the three phenolic stabilizers YSt-1, YSt-4 and YSt-5. These data thus provide further support for the advantages claimed for the stabilizers of this invention, now expressed in the context of a multilayer coating.

Additional evidence to illustrate the advantages of the invention is also available from consideration of the remaining entries in Table 5, consisting of coatings of dispersions made with trihexyl citrate as coupler solvent. Comparison between dispersions 65 and 66 shows that doubling the concentration of stabilizer YSt-4 produces a small improvement in stability of the yellow image, but also reduces coupling reactivity. However, dispersion 67, which incorporates a mixture of stabilizers S-I-1 and YSt-4 to the same total stabilizer concentration as dispersion 66, gives an even larger improvement in stability, and equally importantly, overcomes the activity penalty seen in dispersion 66. As might be expected, even better light stability is obtained by increasing the total stabilizer concentration (compare dispersions 68 and 67), but it is notable that there is in this case no loss in coupling reactivity. Dispersion 69, which contains the same total stabilizer concentration as dispersion 68, but made up of a mixture of the three phenolic stabilizers YSt-1, YSt4 and YSt-5, provides neither the same level of stability nor the improved activity shown by the dispersion 68 coating. The benefits of stabilizer combinations containing stabilizer S-I-1 are thus confirmed.

The invention has been described by reference to preferred embodiments, but it will be understood changes can be made to the embodiments specifically described herein within the spirit and scope of the invention.

What is claimed is:

1. A photographic element comprising a silver halide emulsion layer having associated therewith an acetanilide-based yellow dye-forming coupler and a stabilizer compound of the formula S-I:

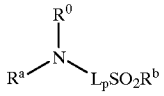

wherein $R^0$ represents an alkyl or heterocyclic group;

$R^a$ is H or a substituent group;

L represents an alkylene linking group and p represents 0 or 1; and $R^b$ is a substituent group, provided that substituent groups represented by $R^a$ and $R^b$ may be joined to form a ring; and wherein the silver halide emulsion layer further has associated therewith a substituted phenolic light stabilizer compound.

2. An element according to claim 1, wherein $R^0$ represents a substituted phenyl group of the formula:

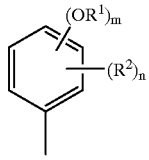

wherein m is 1, 2, 3, 4 or 5;

n is 0, 1, 3, or 4, provided that the sun of m and n is less than or equal to 5; and $R^1$ is H or a substituent group and $R^2$ is a substituent group, provided that substituent groups represented by $R^1$ and $R^2$ or two $R^1$ or two $R^2$ groups may be joined to form a ring.

3. An element according to claim 2, wherein $R^0$ represents a para-substituted group of the formula:

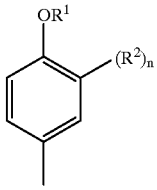

wherein n is 0 or 1.

4. An element according to claim 3 wherein p is 1 and L is an alkylene group of from 1 to 4 carbon atoms.

5. An element according to claim 4 wherein $R^a$ and $R^b$ join together to form a ring.

6. An element according to claim 5 wherein L is an ethylene group and $R^a$ and $R^b$ join together to complete a thiomorpholine dioxide group.

7. An element according to claim 6 wherein $R^1$ is an alkyl group.

8. An element according to claim 7 wherein n is 0.

9. An element according to claim 3 wherein $R^a$ is H, p is 0, and $R^b$ is an alkyl group of from 1 to 16 carbon atoms.

10. An element according to claim 9, wherein $R^1$ is an alkyl group.

11. An element according to claim 1, wherein the molar ratio of stabilizer compound of formula S-I to substituted phenolic light stabilizer compound is from 1:12 to 25:1.

12. An element according to claim 1, wherein the substituted phenolic light stabilizer compound is a substituted bisphenolic light stabilizer compound.

13. An element according to claim 12 wherein the substituted bisphenol compound is of the formula:

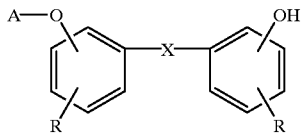

wherein A represents an alkyl, cycloalkyl, alkenyl, aryl, acyl, alkylsulfonyl or arylsulfonyl group, X represents a single bond or a bivalent linking group, and each R independently represents one or more alkyl, alkenyl, cycloalkyl, or aryl group, or in combination with the benzene ring to which it is attached represents the atoms necessary to complete a fused ring system.

14. An element according to claim 13, wherein the molar ratio of stabilizer compound of formula S-I to substituted bisphenolic light stabilizer compound is from 1:12 to 25:1.

15. An element according to claim 13, wherein X represents a single bond or an alkylidene group, oxygen, sulfur, selenium, tellurium, or a sulfonyl or phosphinyl group.

16. An element according to claim 13, wherein X represents an alkylidene group.

17. An element according to claim 1, wherein the yellow coupler is of the formula

YELLOW-1

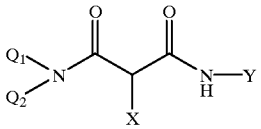

YELLOW-2

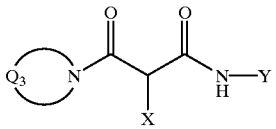

YELLOW-3

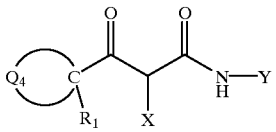

or

YELLOW-4

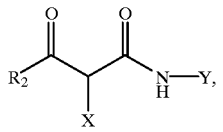

wherein $R_1$, $R_2$, $Q_1$ and $Q_2$ each represent a substituent; X is hydrogen or a coupling-off group; Y represents an aryl group or a heterocyclic group; $Q_3$ represents an organic residue required to form a nitrogen-containing heterocyclic group together with the illustrated nitrogen atom; and $Q_4$ represents nonmetallic atoms necessary to form a 3- to 5-membered hydrocarbon ring or a 3- to 5-membered heterocyclic ring which contains at least one hetero atom selected from N, O, S, and P in the ring.

18. An element according to claim 17, wherein the yellow coupler is of the formula YELLOW-4 where $R_2$ represents an aryl or alkyl group and Y represents an aryl group.

19. An element according to claim 18, wherein $R_2$ represents a tertiary alkyl group.

20. An element according to claim 1, wherein the molar ratio of stabilizer compound of formula S-I to yellow coupler is from 0.05 to 2.0 moles stabilizer per mole of coupler.

21. An element according to claim 1, wherein the molar ratio of stabilizer compound of formula S-I to yellow coupler is from 0.1 to 1.0 moles stabilizer per mole of coupler.

22. A photographic element comprising a silver halide emulsion layer having associated therewith an acetanilide-based yellow dye-forming coupler and a stabilizer compound of the formula S-I:

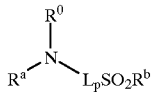

wherein $R^0$ represents a para-substituted phenyl group of the formula:

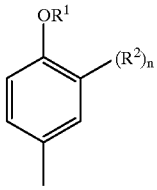

wherein n is 0 or 1, $R^1$ is H or a substituent group and $R^2$ is a substituent group, provided that substituent groups represented by $R^1$ and $R^2$ groups may be joined to form a ring; and $R^a$ is H, L represents an alkylene linking group, p is 0, and $R^b$ is an alkyl group of from 1 to 16 carbon atoms.

23. An element according to claim 4, wherein $R^1$ is an alkyl group.

* * * * *